US010227970B2

(12) United States Patent
Gisolf et al.

(10) Patent No.: US 10,227,970 B2
(45) Date of Patent: Mar. 12, 2019

(54) DETERMINING PUMP-OUT FLOW RATE

(71) Applicant: Schlumberger Technology Corporation, Sugar Land, TX (US)

(72) Inventors: Adriaan Gisolf, Sugar Land, TX (US); Youxiang Zuo, Burnaby (CA); Yi Chen, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 215 days.

(21) Appl. No.: 15/183,432

(22) Filed: Jun. 15, 2016

(65) Prior Publication Data

US 2017/0363077 A1 Dec. 21, 2017

(51) Int. Cl.

| | |
|---|---|
| ***F04B 49/06*** | (2006.01) |
| ***E21B 47/00*** | (2012.01) |
| ***E21B 49/08*** | (2006.01) |
| ***F04B 49/22*** | (2006.01) |
| ***F04B 47/02*** | (2006.01) |
| ***F04B 53/14*** | (2006.01) |

(52) U.S. Cl.

CPC ..... *F04B 49/065* (2013.01); *E21B 47/0007* (2013.01); *E21B 49/081* (2013.01); *F04B 47/02* (2013.01); *F04B 49/22* (2013.01); *F04B 53/14* (2013.01)

(58) Field of Classification Search

CPC ..... F04B 49/065; F04B 49/22; F04B 43/129; F04B 47/02; F04B 53/14; G05B 19/416; G05B 2219/37371; E21B 47/0007; E21B 47/18; E21B 49/081; E21B 2049/085

USPC ..... 700/282

See application file for complete search history.

(56) References Cited

U.S. PATENT DOCUMENTS

| | | | | |
|---|---|---|---|---|
| 5,687,791 | A | 11/1997 | Beck et al. | |
| 5,799,733 | A | 9/1998 | Ringgenberg et al. | |
| 6,592,334 | B1 | 7/2003 | Butler | |
| 6,609,568 | B2 | 8/2003 | Volker et al. | |
| 6,859,740 | B2 | 2/2005 | Stephenson et al. | |
| 7,234,521 | B2 | 6/2007 | Shammai et al. | |
| 7,644,610 | B2 | 1/2010 | Meister | |
| 7,665,354 | B2 | 2/2010 | Shammai | |
| 9,322,267 | B2 | 4/2016 | Pop et al. | |
| 9,359,892 | B2 | 7/2016 | Tao | |
| 2009/0128818 | A1 * | 5/2009 | Goodwin | E21B 49/10 356/436 |
| 2009/0252616 | A1 | 10/2009 | Brunet et al. | |

(Continued)

*Primary Examiner* — Robert E Fennema
*Assistant Examiner* — Jigneshkumar C Patel
(74) *Attorney, Agent, or Firm* — Michael Dae

(57) ABSTRACT

First piston position data of a piston in a displacement unit is obtained based on an output signal from a sensor associated with the displacement unit, the output signal being dependent upon a physical position of the piston in the displacement unit. Second piston position data of the piston in the displacement unit is obtained based on data indicative of a number of revolutions of a hydraulic motor in a hydraulic system, the hydraulic system being operable to drive the piston of the displacement unit. Based on the second piston position data, a flow rate of a fluid pumped by the displacement unit is estimated. A system correction factor is generated based on the first piston position data and the second piston position data. The estimated flow rate is adjusted based on the system correction factor.

20 Claims, 14 Drawing Sheets

(56) References Cited

U.S. PATENT DOCUMENTS

| | | | | |
|---|---|---|---|---|
| 2011/0048700 | A1* | 3/2011 | van Zuilekom ..... | E21B 49/08 166/250.01 |
| 2011/0100623 | A1* | 5/2011 | Bebb ..... | E21B 41/00 166/250.01 |
| 2011/0100641 | A1 | 5/2011 | Briquet et al. | |
| 2016/0177714 | A1 | 6/2016 | Tao et al. | |
| 2016/0177942 | A1 | 6/2016 | Tao et al. | |

* cited by examiner

DETERMINING PUMP-OUT FLOW RATE

BACKGROUND OF THE DISCLOSURE

In order to successfully exploit subterranean hydrocarbon reserves, information about the subterranean formations and formation fluids intercepted by a wellbore is acquired. This information may be acquired via sampling formation fluids during various drilling and/or testing operations. The fluid may be collected and analyzed, for example, to ascertain composition and production characteristics of hydrocarbon fluid reservoirs.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a processing system having a processor and a memory including computer program code. The processing system is operable to obtain first piston position data of a piston in a displacement unit based on an output signal from a sensor associated with the displacement unit, the output signal being dependent upon a physical position of the piston in the displacement unit. The processing system is also operable to obtain second piston position data of the piston in the displacement unit based on data indicative of a number of revolutions of a hydraulic motor in a hydraulic system, the hydraulic system being operable to drive the piston of the displacement unit. The processing system is also operable to estimate, based on the second piston position data, an estimated flow rate of a fluid pumped by the displacement unit. The processing system is also operable to generate a system correction factor based on the first piston position data and the second piston position data. The processing system is also operable to adjust the estimated flow rate based on the system correction factor.

The present disclosure also introduces an apparatus including a downhole tool and a processing system. The downhole tool includes a flow line, a hydraulic system, a displacement unit, and a sensor. The displacement unit is operable to pump a fluid through the flow line. The hydraulic system includes a hydraulic motor operable to cause a piston of the displacement unit to be driven. The sensor is associated with the displacement unit and is operable to output a signal that is dependent on a physical position of the piston in the displacement unit. The processing system includes a processor and a memory including computer program code. The processing system is operable to estimate an estimated flow rate of the pumped fluid based on a first difference between first data corresponding to a current data sampling time and the first data corresponding to a previous data sampling time. The first data is indicative of a position of the piston based on a number of revolutions of the hydraulic motor. The processing system is also operable to correct the estimated flow rate based on a correction factor. The correction factor is based on a first ratio of a second difference of second data corresponding to different, previous data sampling times and a third difference of the first data corresponding to the different, previous data sampling times. The second data is indicative of a position of the piston based on the signal output from the sensor.

The present disclosure also introduces a method including operating a processing system having a processor and a memory including computer program code. Operating the processing system includes obtaining first data indicative of a position of a piston in a displacement unit for a stroke. The first data is derived from an output of a sensor associated with the displacement unit. The output of the sensor is dependent on a physical position of the piston in the displacement unit. Operating the processing system also includes obtaining second data indicative of the position of the piston for the stroke. The second data is derived from a number of revolutions of a motor in a hydraulic system operable to drive the piston in the displacement unit. Operating the processing system also includes estimating an estimated flow rate of a fluid pumped by the displacement unit based on a first difference between second data corresponding to a current data sampling time for the stroke and the second data corresponding to a previous data sampling time for the stroke. Operating the processing system also includes correcting the estimated flow rate based on a system correction factor. The system correction factor is derived from a first ratio of: a second difference of the first data corresponding to different, previous data sampling times for the stroke; and a third difference of the second data corresponding to the different, previous data sampling times for the stroke.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of description.

DETAILED DESCRIPTION

Figure 1:
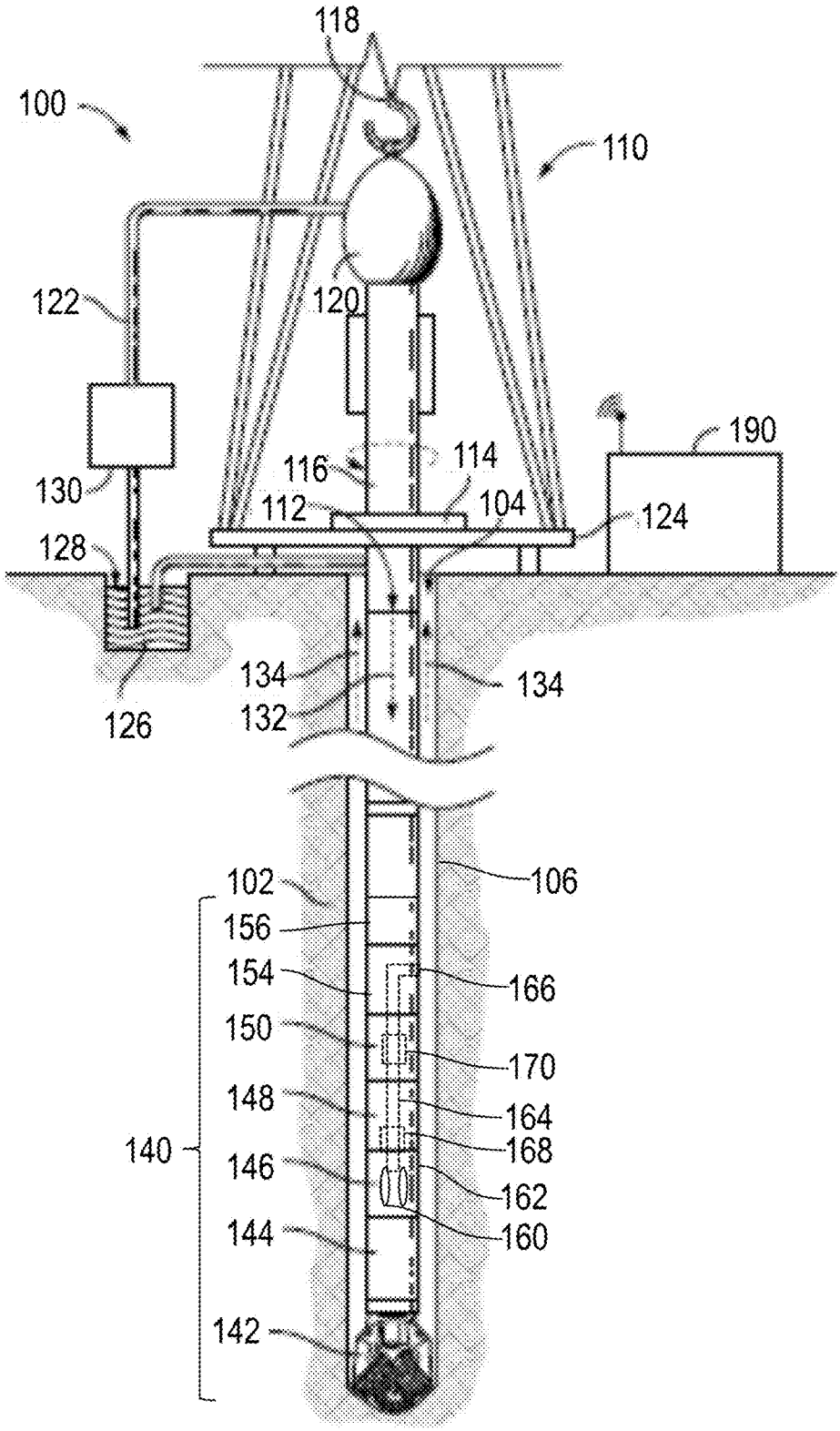
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations described herein.

Systems and methods and/or processes according to one or more aspects of the present disclosure may be used or performed in connection with formation evaluation using fluid sampling and analysis. Flow rates and volumes of fluid pumped into and through a downhole tool used for the fluid sampling and analysis can be used to control an amount of fluid that is pumped from a subterranean formation. Additionally, the flow rate of the fluid pumped through the tool may be used for transient testing and other data interpretation during downhole fluid analysis (DFA).

One or more aspect of systems and methods and/or processes of the present disclosure may provide for increased accuracy in a determined flow rate, and possibly determined continuous volume, in a tool used in fluid sampling and analysis. For example, a sensor, such as a giant magnetoresistance (GMR) sensor, may be used to correct a flow rate and/or continuous volume that may initially be calculated by less accurate means, and thereby, a more accurate flow rate and/or continuous volume may be determined. With a more accurate flow rate and/or continuous volume being determined, control of the fluid sampling may be more precise, and transient testing and other data interpretation during DFA may be more accurate.

Some example systems are provided herein for context to understand one or more aspects of methods and/or processes disclosed herein. A person having ordinary skill in the art will readily understand that one or more aspects of methods and/or processes disclosed herein may be used in other contexts, including other systems in which a flow rate and/or pumped volume may be determined.

FIG. 1 is a schematic view of an example wellsite system 100 to which one or more aspects of the present disclosure may be applicable. The wellsite system 100 may be onshore or offshore. In the example wellsite system 100 shown in FIG. 1, a wellbore 104 is formed in one or more subterranean formation 102 by rotary drilling. Other example systems within the scope of the present disclosure may also or instead utilize directional drilling. While some elements of the wellsite system 100 are depicted in FIG. 1 and described below, it is to be understood that the wellsite system 100 may include other components in addition to, or in place of, those presently illustrated and described.

As shown in FIG. 1, a drillstring 112 suspended within the wellbore 104 comprises a bottom hole assembly (BHA) 140 that includes or is coupled with a drill bit 142 at its lower end. The surface system includes a platform and derrick assembly 110 positioned over the wellbore 104. The platform and derrick assembly 110 may comprise a rotary table 114, a kelly 116, a hook 118, and a rotary swivel 120. The drillstring 112 may be suspended from a lifting gear (not shown) via the hook 118, with the lifting gear being coupled to a mast (not shown) rising above the surface. An example lifting gear includes a crown block whose axis is affixed to the top of the mast, a vertically traveling block to which the hook 118 is attached, and a cable passing through the crown block and the vertically traveling block. In such an example, one end of the cable is affixed to an anchor point, whereas the other end is affixed to a winch to raise and lower the hook 118 and the drillstring 112 coupled thereto. The drillstring 112 comprises one or more types of tubular members, such as drill pipes, threadedly attached one to another, perhaps including wired drilled pipe.

The drillstring 112 may be raised and lowered by turning the lifting gear with the winch, which may sometimes include temporarily unhooking the drillstring 112 from the lifting gear. In such scenarios, the drillstring 112 may be supported by blocking it with wedges (known as "slips") in a conical recess of the rotary table 114, which is mounted on a platform 124 through which the drillstring 112 passes.

The drillstring 112 may be rotated by the rotary table 114, which engages the kelly 116 at the upper end of the drillstring 112. The drillstring 112 is suspended from the hook 118 and extends through the kelly 116 and the rotary swivel 120 in a manner permitting rotation of the drillstring 112 relative to the hook 118. Other example wellsite systems within the scope of the present disclosure may utilize a top drive system to suspend and rotate the drillstring 112, whether in addition to or instead of the illustrated rotary table system.

The surface system may further include drilling fluid or mud 126 stored in a pit or other container 128 formed at the wellsite. As described above, the drilling fluid 126 may be oil-based mud (OBM) or water-based mud (WBM). A pump 130 delivers the drilling fluid 126 to the interior of the drillstring 112 via a hose or other conduit 122 coupled to a port in the rotary swivel 120, causing the drilling fluid to flow downward through the drillstring 112, as indicated in FIG. 1 by directional arrow 132. The drilling fluid exits the drillstring 112 via ports in the drill bit 142, and then circulates upward through the annulus region between the outside of the drillstring 112 and the wall 106 of the wellbore 104, as indicated in FIG. 1 by directional arrows 134. In this manner, the drilling fluid 126 lubricates the drill bit 142 and carries formation cuttings up to the surface as it is returned to the container 128 for recirculation.

The BHA 140 may comprise one or more specially made drill collars near the drill bit 142. Each such drill collar may comprise one or more logging devices, thereby permitting measurement of downhole drilling conditions and/or various characteristic properties of the subterranean formation 102 intersected by the wellbore 104. For example, the BHA 140 may comprise one or more logging-while-drilling (LWD)

modules, such as a probe module 146, a fluid analysis module 148, a pump-out module 150, and a fluid sampling module 154; a measurement-while-drilling (MWD) module 156; a rotary-steerable system and motor 144; and perhaps the drill bit 142. Of course, other BHA components, modules, and/or tools are also within the scope of the present disclosure, and such other BHA components modules and/or tools may be positioned differently in the BHA 140.

The MWD module 156 may comprise one or more devices for measuring characteristics of the drillstring 112 and/or drill bit 142, such as for measuring weight-on-bit, torque, vibration, shock, stick slip, direction, and/or inclination, among others. The MWD module 156 may further comprise an apparatus (not shown) for generating electrical power to be utilized by the downhole system. This may include a mud turbine generator powered by the flow of the drilling fluid 126. Other power and/or battery systems may also or instead be employed.

The probe module 146 may include a selectively extendible fluid admitting assembly with one or more inlets 160 and one or more deployable members 162 respectively arranged on opposite sides of the BHA 140. The fluid admitting assembly with the inlet(s) 160 may be operable to selectively seal off or isolate selected portions of a wall 106 of the wellbore 104 such that fluid communication with the adjacent subterranean formation 102 may be established. The one or more inlets 160 may engage or be positioned adjacent to the wall 106 of the wellbore 104 to receive therein formation fluid and/or other fluid located within the subterranean formation 102 and/or the wellbore 104. The fluid received into the probe module 146 through the one or more inlets 160 is collectively referred to hereinafter as a "downhole fluid." The one or more inlets 160 may be for focused or un-focused fluid sampling.

The one or more deployable members 162 may be operable to place the inlet(s) 160 into engagement with the wall 106 of the wellbore 104. For example, the deployable members 162 may be or comprise an inflatable packer that may be expanded circumferentially around the probe module 146 to extend the inlet(s) 160 into engagement with the wall 106. The one or more deployable members 162 may also or instead comprise one or more setting pistons that may be extended against one or more points on the wall 106 of the wellbore 104 to urge the inlet(s) 160 against the wall 106. The inlet(s) 160 may also or instead be disposed on one or more extendable probes operable to extend away from the BHA 140 to engage the wall 106.

The fluid analysis module 148 may include a fluid analyzer 168 operable for in situ downhole fluid evaluation. For example, the fluid analyzer 168 may include a spectrometer and/or a gas analyzer operable to measure various fluid properties, such as optical density, fluid density, fluid viscosity, fluid fluorescence, fluid composition, and fluid gas-oil ratio, among others. The spectrometer may include a number of measurement channels for detecting different wavelengths, and may include a filter-array spectrometer or a grating spectrometer. For example, the spectrometer may be a filter-array absorption spectrometer having ten measurement channels. In other implementations, the spectrometer may have sixteen channels or twenty channels, and may be provided as a filter-array spectrometer, a grating spectrometer, or a combination thereof (e.g., a dual spectrometer). The fluid analyzer 168 may include one or more photodetector arrays that detect reflected light rays. The fluid analyzer 168 may also include a light emitting diode (LED) and/or other light source, a sapphire and/or other material prism, and a polarizer, among other components. The fluid analyzer 168 may include a gas detector and one or more fluorescence detectors operable to detect free gas bubbles and retrograde condensate liquid drop out.

One or more additional measurement devices, such as temperature sensors, pressure sensors, viscosity sensors, chemical sensors (e.g., for measuring pH or $H_2S$ levels), and gas chromatographs, may also be included within the fluid analyzer 168. The fluid analyzer 168 may also include a resistivity sensor and/or a density sensor, which, for example, may be a densimeter or a densitometer.

The pump-out module 150 includes a pump assembly 170 that draws the downhole fluid through one or more flow lines 164 extending within the BHA 140. In the illustrated implementation, the flow line 164 provides fluid communication between the one or more inlets 160 and an outlet 166. As shown in FIG. 1, the flow line 164 extends from the probe module 146 and through the fluid analysis module 148 before reaching the pump-out module 150. Fluids obtained from the subterranean formation 102 and/or wellbore 104 flow through the flow line 164 and may be discharged through the outlet 166. In other implementations, the arrangement of the modules 146, 148, and 150 may vary. For example, the fluid analysis module 148 may be disposed on the other side of the pump-out module 150. As further shown in FIG. 1, the flow line 164 may also extend through the fluid sampling module 154 before reaching the outlet 166.

The fluid sampling module 154 may selectively retain some downhole fluid for transport to the surface for further evaluation outside the wellbore 104. For example, downhole fluid in the flow line 164 may be directed to one or more fluid collecting chambers (not shown) in the BHA 140 for receiving and retaining the fluids obtained from the subterranean formation 102 for transportation to the surface.

The wellsite system 100 also includes a data processing system that can include one or more, or portions thereof, of the following: the surface equipment 190, control devices and electronics in one or more modules of the BHA 140, a remote computer system (not shown), communication equipment, and other equipment. The data processing system may include one or more computer systems or devices and/or may be a distributed computer system. For example, collected data or information may be stored, distributed, communicated to an operator, and/or processed locally or remotely.

The data processing system may, individually or in combination with other system components, perform the methods and/or processes described below, or portions thereof. For example, such data processing system may include processor capability for collecting data relating to the pumping of downhole fluids by the pump assembly 170 in the BHA 140 according to one or more aspects of the present disclosure. Methods and/or processes within the scope of the present disclosure may be embodied in one or more computer programs that run in a processor located, for example, in one or more modules of the BHA 140 and/or the surface equipment 190. Such programs may utilize data received from, for example, the pump-out module 150, via mud-pulse telemetry and/or other telemetry means, and may transmit control signals to operative elements of the BHA 140. The programs may be stored on a tangible, non-transitory, computer-usable storage medium associated with the one or more processors of the BHA 140 and/or surface equipment 190, or may be stored on an external, tangible, non-transitory, computer-usable storage medium that is electronically coupled to such processor(s). The storage medium may be one or more known or future-developed storage media, such as a magnetic disk, an optically readable disk, flash memory, or a readable device of another kind, including a remote storage device coupled over a switched telecommunication link, among others.

Figure 2:
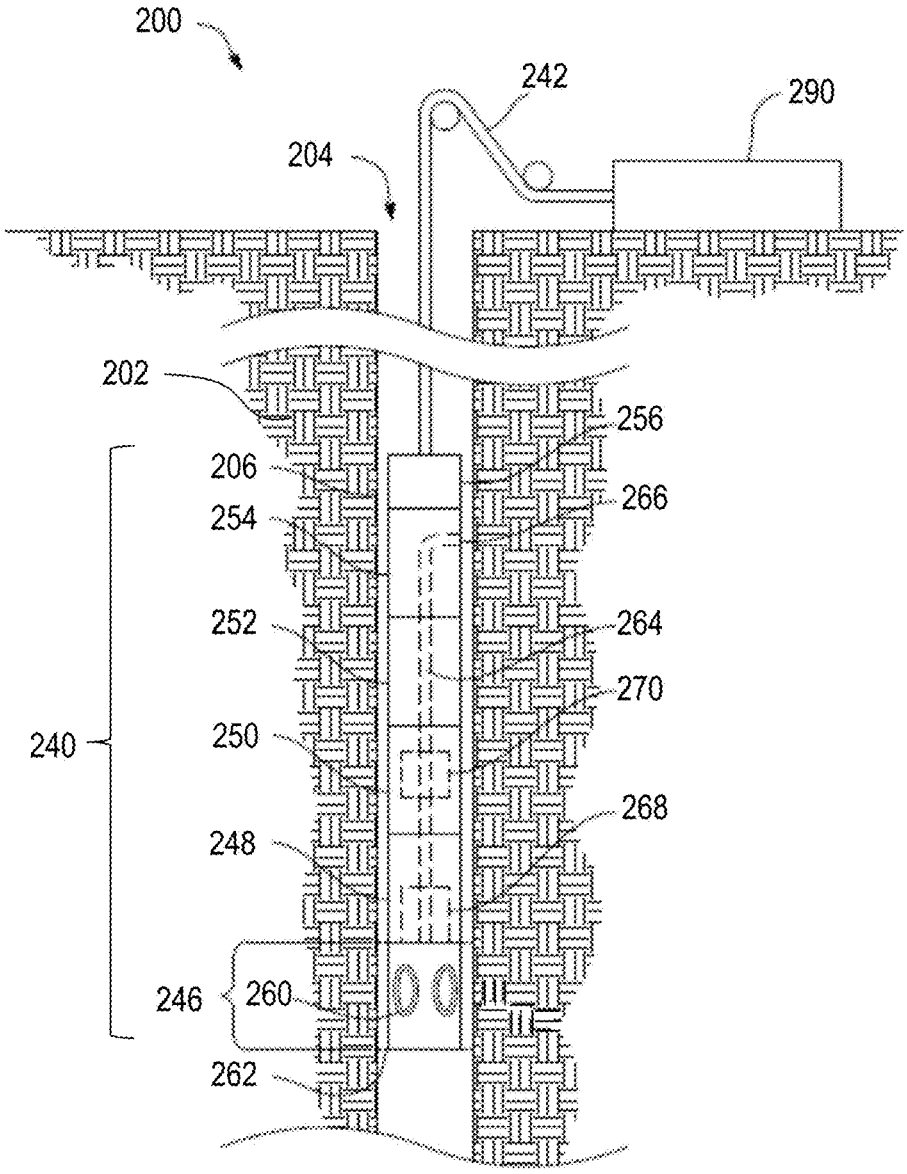
FIG. 2 is a schematic view of at least a portion of an example implementation of apparatus according to one or more aspects of the present disclosure.

FIG. 2 is a schematic view of another example wellsite system 200 to which one or more aspects of the present disclosure may be applicable. The wellsite system 200 may be onshore or offshore. In the example wellsite system 200 shown in FIG. 2, a downhole sampling tool 240 is conveyed into a wellbore 204 extending through one or more subterranean formations 202, such as via a wireline (and/or other conveyance means) 242. As with the wellsite system 100 shown in FIG. 1, the example wellsite system 200 of FIG. 2 may be utilized for downhole sampling and analysis of formation fluids. The downhole sampling tool 240 may be used for testing one or more subterranean formations 202 and analyzing the fluids obtained from the subterranean formation 202. While some elements of the wellsite system 200 are depicted in FIG. 2 and described below, it is to be understood that the wellsite system 200 may include other components in addition to, or in place of, those presently illustrated and described.

The downhole sampling tool 240 is suspended in the wellbore 204 from the lower end of the wireline 242, which may be a multi-conductor logging cable spooled on a winch (not shown). The wireline 242 may include at least one conductor that facilitates data communication between the downhole sampling tool 240 and surface equipment 290 disposed on the surface. The surface equipment 290 may have one or more aspects in common with the surface equipment 190 shown in FIG. 1.

The downhole sampling tool 240 and wireline 242 may be structured and arranged with respect to a service vehicle (not shown) at the wellsite. For example, the wireline 242 may be connected to a drum (not shown) at the wellsite surface, permitting rotation of the drum to raise and lower the downhole sampling tool 240. The drum may be disposed on a service truck or a stationary platform. The service truck or stationary platform may further contain the surface equipment 290.

The downhole sampling tool 240 comprises an elongated body encasing various electronic components and modules schematically represented in FIG. 2. For example, the illustrated downhole sampling tool 240 includes a probe module 246, a fluid analysis module 248, a pump-out module 250, a power module 252, and a fluid sampling module 254. Other implementations of the downhole sampling tool 240, however, may include additional or fewer components or modules.

The probe module 246 may include a selectively extendible fluid admitting assembly with one or more inlets 260 and one or more deployable members 262 respectively arranged on opposite sides of the elongated body. The fluid admitting assembly may be operable to selectively seal off or isolate selected portions of a wall 206 of the wellbore 204, such that fluid communication with the adjacent subterranean formation 202 may be established. The one or more inlets 260 may engage or be positioned adjacent to the wall 206 of the wellbore 204 to receive therein formation fluid and/or other fluid located within the subterranean formation 202. The fluid received into the probe module 246 through the one or more inlets 260 is downhole fluid, as described above. The one or more inlets 260 may be for focused or un-focused fluid sampling.

The probe module 246 may further include one or more deployable members 262 operable to place the inlets 260 into engagement with the wall 206 of the wellbore 204. For example, the deployable members 262 may be or comprise an inflatable packer that may be expanded circumferentially around the probe module 246 to extend the inlets 260 into engagement with the wall 206. The one or more deployable members 262 may also include one or more setting pistons that may be extended against one or more points on the wall 206 of the wellbore 204 to urge the inlets 260 against the wall 206. The one or more inlets 260 may also be disposed on one or more extendable probes operable to extend into engagement with the wall 206.

The fluid analysis module 248 may include a fluid analyzer 268 operable for in situ downhole fluid evaluation. For example, the fluid analyzer 268 may include a spectrometer and/or a gas analyzer operable to measure various fluid properties, such as optical density, fluid density, fluid viscosity, fluid fluorescence, fluid composition, and fluid gas-oil ratio, among others. The spectrometer may include a number of measurement channels for detecting different wavelengths, and may include a filter-array spectrometer or a grating spectrometer. For example, the spectrometer may be a filter-array absorption spectrometer having ten measurement channels. In other implementations, the spectrometer may have sixteen channels or twenty channels, and may be provided as a filter-array spectrometer, a grating spectrometer, or a combination thereof (e.g., a dual spectrometer). The fluid analyzer 268 may include one or more photodetector arrays that detect reflected light rays. The fluid analyzer 268 may also include an LED and/or other light source, a sapphire and/or other material prism, and a polarizer, among other components. The fluid analyzer 268 may also include a gas detector and one or more fluorescence detectors operable to detect free gas bubbles and retrograde condensate liquid drop out.

One or more additional measurement devices, such as temperature sensors, pressure sensors, viscosity sensors, chemical sensors (e.g., for measuring pH or $H_2S$ levels), and gas chromatographs, may also be included within the fluid analyzer 268. The fluid analyzer 268 may also include a resistivity sensor and/or a density sensor, which, for example, may be a densimeter or a densitometer.

The pump-out module 250 includes a pump assembly 270 that draws the downhole fluid through one or more flow lines 264 extending within the downhole sampling tool 240. In the illustrated implementation, the flow line 264 provides fluid communication between the one or more inlets 260 and an outlet 266. As shown in FIG. 2, the flow line 264 extends from the probe module 246 and through the fluid analysis module 248 before reaching the pump-out module 250. Fluids obtained from the subterranean formation 202 flow through the flow line 264 and may be discharged through the outlet 266. In other implementations, the arrangement of the modules 246, 248, and 250 may vary. For example, the fluid analysis module 248 may be disposed on the other side of the pump-out module 250. As further shown in FIG. 2, the flow line 264 may also extend through the power module 252 and the fluid sampling module 254 before reaching the outlet 266.

The fluid sampling module 254 may selectively retain some downhole fluid for transport to the wellsite surface for further evaluation outside the wellbore 204. For example, downhole fluid in the flow line 264 may be directed to one or more fluid collecting chambers (not shown) in the downhole sampling tool 240 for receiving and retaining the fluids obtained from the subterranean formation 202 for transportation to the surface.

The wellsite system 200 also includes a data processing system that can include one or more, or portions thereof, of the following: the surface equipment 290, control devices and electronics in one or more module of the downhole sampling tool 240 (such as a downhole controller 256 or as part of another module), a remote computer system (not shown), communication equipment, and other equipment. The data processing system may include one or more computer systems or devices and/or may be a distributed computer system. For example, collected data or information may be stored, distributed, communicated to an operator, and/or processed locally or remotely.

The data processing system may, individually or in combination with other system components, perform the methods and/or processes described below, or portions thereof. For example, such data processing system may include processor capability for collecting data relating to the pumping of downhole fluids by the pump assembly 270 according to one or more aspects of the present disclosure. Methods and/or processes within the scope of the present disclosure may be embodied in one or more computer programs that run in a processor located, for example, in one or more modules of the downhole sampling tool 240 and/or the surface equipment 290. Such programs may utilize data received from, for example, the pump-out module 250, via the wireline 242, and may transmit control signals to operative elements of the downhole sampling tool 240. The programs may be stored on a tangible, non-transitory, computer-usable storage medium associated with the one or more processors of the downhole sampling tool 240 and/or surface equipment 290, or may be stored on an external, tangible, non-transitory, computer-usable storage medium that is electronically coupled to such processor(s). The storage medium may be one or more known or future-developed storage media, such as a magnetic disk, an optically readable disk, flash memory, or a readable device of another kind, including a remote storage device coupled over a switched telecommunication link, among others.

While FIGS. 1 and 2 illustrate example wellsite systems 100 and 200, respectively, that convey a downhole tool comprising a pump-out module into a wellbore, other example implementations consistent with the scope of this disclosure may utilize other conveyance means to convey a tool into a wellbore, including coiled tubing, tough logging conditions (TLC), slickline, and others. Additionally, other downhole tools within the scope of the present disclosure may comprise components in a non-modular construction also consistent with the scope of this disclosure.

Figure 3:
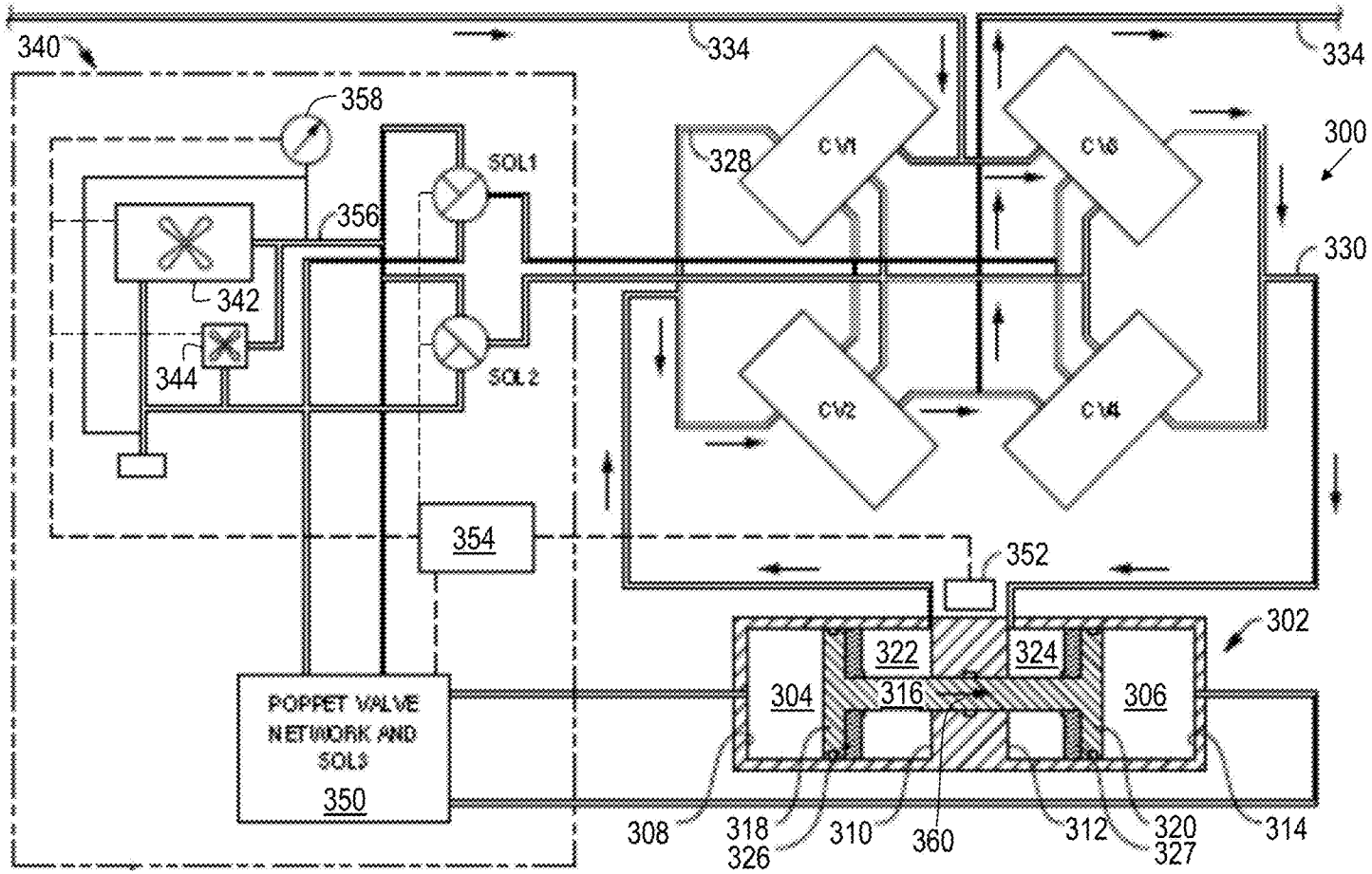
FIG. 3 is a schematic view of at least a portion of an example implementation of apparatus according to one or more aspects of the present disclosure.
Figure 4:
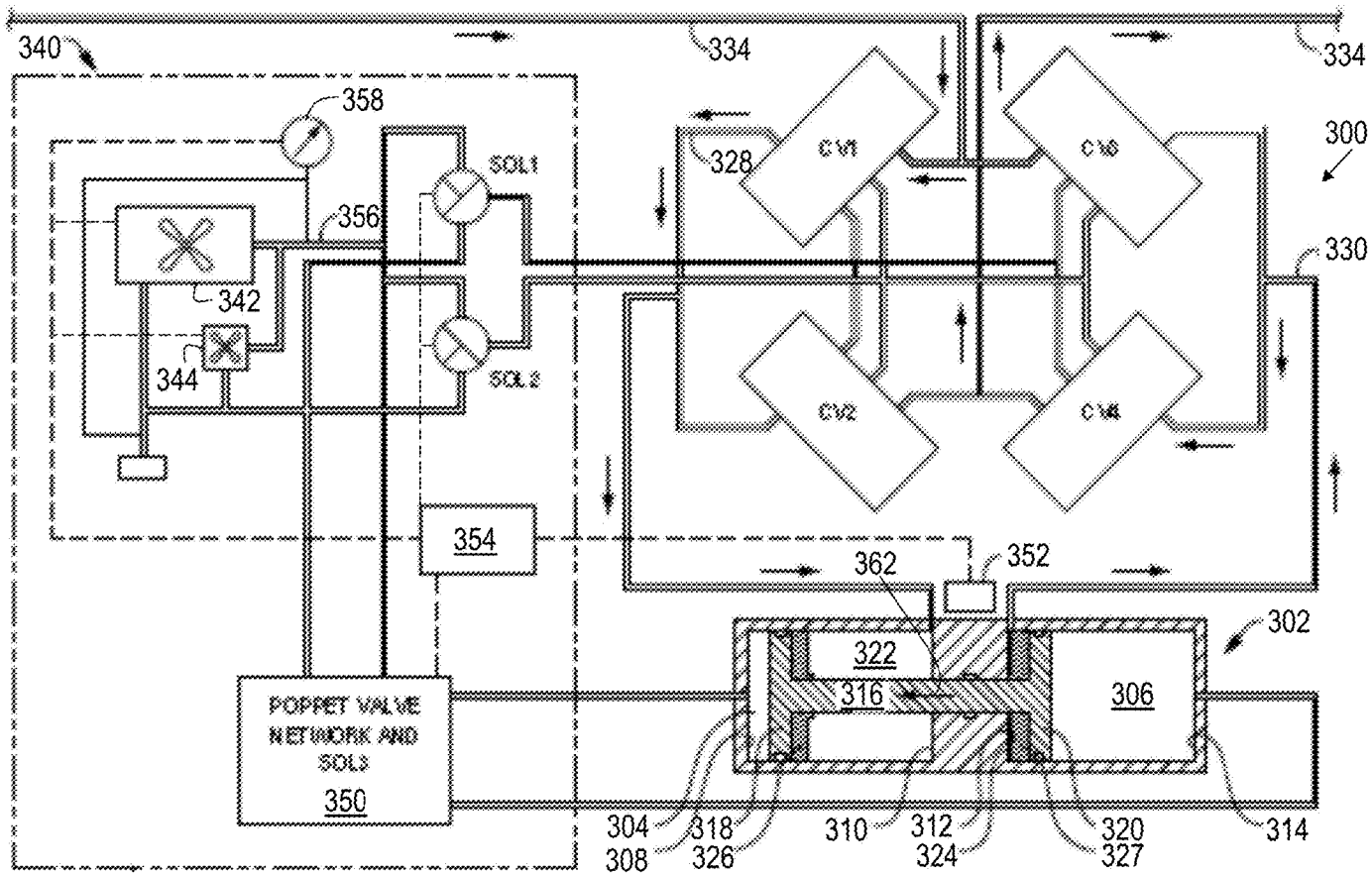
FIG. 4 is a schematic view of at least a portion of an example implementation of apparatus according to one or more aspects of the present disclosure.

FIGS. 3 and 4 are schematic views of a portion of an example implementation of a pump assembly 300, such as the pump assembly 170 and 270 in the pump-out module 150 and 250 shown in FIGS. 1 and 2, respectively, according to one or more aspects of the present disclosure. The pump assembly 300 (e.g., pump assembly 170, 270) may be utilized to: draw the downhole fluid from a wellbore (e.g., wellbore 104, 204) or a subterranean formation (e.g., subterranean formation 102, 202) and into a flow line (e.g., flow line 164, 264) via a probe module (e.g., probe module 146, 246); pump the downhole fluid into one or more sample chambers within a fluid sample module (e.g., fluid sample module 154, 254); and/or dispose of the downhole fluid by pumping the downhole fluid through the flow line into the wellbore through an outlet (e.g., outlet 166, 266). In other words, the pump assembly 300 may be utilized for pumping the downhole fluid into, through, and out of the BHA 140 of FIG. 1 or the downhole sampling tool 240 of FIG. 2.

The pump assembly 300 includes a displacement unit 302. In the example implementation depicted in FIGS. 3 and 4, the displacement unit 302 is a positive displacement, two-stroke piston pump. The displacement unit 302 may be driven by the hydraulic fluid discharged by a control system 340, which includes a first motor and pump assembly ("motor/pump assembly") 342 and a second motor/pump assembly 344. To drive the displacement unit 302, a hydraulic circuit 356 (e.g., a plurality of flow lines) provides hydraulic fluid from the first motor/pump assembly 342 and the second motor/pump assembly 344 via a poppet valve network 350, which includes a solenoid valve SOL3. In the motor/pump assemblies 342, 344, the motor may be an electric motor that drives the pump, and the pump pumps the hydraulic fluid through the hydraulic circuit 356.

The displacement unit 302 comprises a first cylinder 304 and a second cylinder 306. The first cylinder 304 is formed between a first end wall 308 and a second end wall 310, while the second cylinder 306 is formed between a first end wall 312 and a second end wall 314. The displacement unit 302 further comprises a piston 316, which includes a first piston head 318 disposed within the first cylinder 304 and a second piston head 320 disposed within the second cylinder 306. A first chamber 322 is formed between the first piston head 318 and the second end wall 310, and a second chamber 324 is formed between the second piston head 320 and the first end wall 312. The first piston head 318 may be connected with or carry a magnet and/or other detectable feature 326. The second piston head 320 may also or instead be connected with or carry a second magnet and/or other detectable feature 327.

The piston 316 is movable within the displacement unit 302 between a first end of the stroke position, shown in FIG. 4, in which the first piston head 318 and second piston head 320 are proximate the first end walls 308, 312, respectively, and a second end of the stroke position (not shown), in which the first piston head 318 and second piston head 320 are proximate the second end walls 310, 314, respectively. As shown in FIG. 3, the piston 316 is movable in a first stroke direction, indicated by arrow 360, from the first end of the stroke position toward the second end of the stroke position. As shown in FIG. 4, the piston 316 is also movable in a second stroke direction, indicated by arrow 362, from the second end of the stroke position toward the first end of the stroke position. The piston 316 may complete a full stroke when the piston 316 travels a distance that is substantially equal to the distance between the first end wall 308 and the second end wall 310 or between the first end wall 312 and the second end wall 314. Each pump cycle may comprise two consecutive full strokes of the piston 316.

The solenoid valve SOL3 and associated poppet valve network 350 or other hydraulic circuitry may be provided to deliver the hydraulic fluid from the first and/or second motor/pump assemblies 342, 344 to the first cylinder 304 and second cylinder 306 to drive and reciprocate the piston 316 of the displacement unit 302. For example, as shown in FIG. 3, during the first stroke direction 360, the hydraulic fluid is provided from the motor/pump assembly(ies) 342, 344 via the solenoid valve SOL3 and the associated poppet valve network 350 to the first cylinder 304 while the hydraulic fluid is drawn from the second cylinder 306 by the motor/pump assembly(ies) 342, 344 via the solenoid valve SOL3 and the associated poppet valve network 350. This creates a pressure differential between the first cylinder 304 and the second cylinder 306 to drive the piston 316 in the first stroke direction 360.

Similarly, during the second stroke direction 362, as shown in FIG. 4, the hydraulic fluid is provided from the motor/pump assembly(ies) 342, 344 via the solenoid valve SOL3 and the associated poppet valve network 350 to the second cylinder 306 while the hydraulic fluid is drawn from the first cylinder 304 by the motor/pump assembly(ies) 342, 344 via the solenoid valve SOL3 and the associated poppet valve network 350. This creates a pressure differential between the first cylinder 304 and the second cylinder 306 to drive the piston 316 in the second stroke direction 362.

The pump assembly 300 also includes flow lines 328, 330, 334 for selectively communicating the downhole fluid to and from the displacement unit 302. For example, the flow line 328 and associated flow control valves CV1, CV2 selectively communicate the downhole fluid from and to a tool string flow line 334 (such as the flow lines 164, 264 shown in FIGS. 1 and 2) to and from, respectively, the first chamber 322 of the displacement unit 302, and the flow line 330 and associated flow control valves CV3, CV4 selectively communicate the downhole fluid from and to the flow line 334 to and from, respectively, the second chamber 324 of the displacement unit 302. The hydraulic fluid is directed by the first and/or second motor/pump assembly(ies) 342, 344 through a control system 340, including solenoid valves SOL1, SOL2, to control the operation of the flow control valves CV1-CV4.

To drive the piston 316 in the first stroke direction 360, the motor/pump assembly(ies) 342, 344 pump hydraulic fluid into the first cylinder 304 and draw hydraulic fluid from the second cylinder 306 while the flow control valves CV2, CV3 are open and the flow control valves CV1, CV4 are closed. Accordingly, downhole fluid is expelled from the first chamber 322 to the tool string flow line 334 via the flow line 328 and the control valve CV2, while downhole fluid is also drawn from the tool string flow line 334 into the second chamber 324 via the flow line 330 and the control valve CV3.

To drive the piston 316 in the second stroke direction 362, the motor/pump assembly(ies) 342, 344 pump hydraulic fluid into the second cylinder 306 and draw hydraulic fluid from the first cylinder 304 while the flow control valves CV1, CV4 are open and the flow control valves CV2, CV3 are closed. Accordingly, downhole fluid is expelled from the second chamber 324 to the tool string flow line 334 via the flow line 330 and the control valve CV4, while downhole fluid is also expelled from the tool string flow line 334 into the first chamber 322 via the flow line 328 and the control valve CV1.

The control system 340 further includes system electronics 354 that monitor and control various aspects of the operation of the pump assembly 300. For example, the system electronics 354 can control the actuation of the solenoid valves SOL1-SOL3 and the poppet valve network 350 to control the flow of downhole fluid and hydraulic fluid. Additionally, the system electronics 354 can control and monitor the operation of the first and second motor/pump assemblies 342, 344, including monitoring the number of revolutions of each electric motor in the motor/pump assemblies 342, 344, such as by using a tachometer (not shown).

The control system 340 may further include one or more sensors 352 to detect the position of the piston 316. The one or more sensors 352 may include a GMR sensor, a Hall Effect sensor, or another sensor that may detect the magnetic field produced by the first and/or second detectable features 326, 327. The one or more sensors 352 may also be positioned locations (relative to the displacement unit 302) other than as depicted in FIGS. 3 and 4. The system electronics 354 may monitor various outputs from the one or more sensors 352 to determine the position of the piston 316.

The control system 340 may also include a pressure gauge 358 connected to the hydraulic circuit 356. The system electronics 354 may monitor the pressure gauge 358 to determine when an over-pressure condition occurs in the hydraulic circuit 356 and responsively initiate actions to relieve the over-pressure, such as by opening a valve (not shown) to release hydraulic fluid and diminish the hydraulic pressure.

The system electronics 354 may also monitor and control various other operations and/or conditions within the pump assembly 300. For example, the system electronics 354 may perform operations to calibrate the pump assembly 300 during an initialization process.

The system electronics 354 may be a data processing system or a portion thereof. For example, the system electronics 354 may be a data processing system as described below in FIG. 6. In other examples, the system electronics 354 may aggregate data in the pump-out module of the pump assembly 300 that is communicated to a processor of the data processing system, where the processor performs data processing on the communicated data. In further examples, the system electronics 354 may be a part of a distributed data processing system that performs a portion of data processing on the aggregated data while a separate device of the data processing system performs other data processing. The system electronics 354, as at least a part of a data processing system, may perform one or more aspects of various methods and/or processes described herein.

Figure 5:
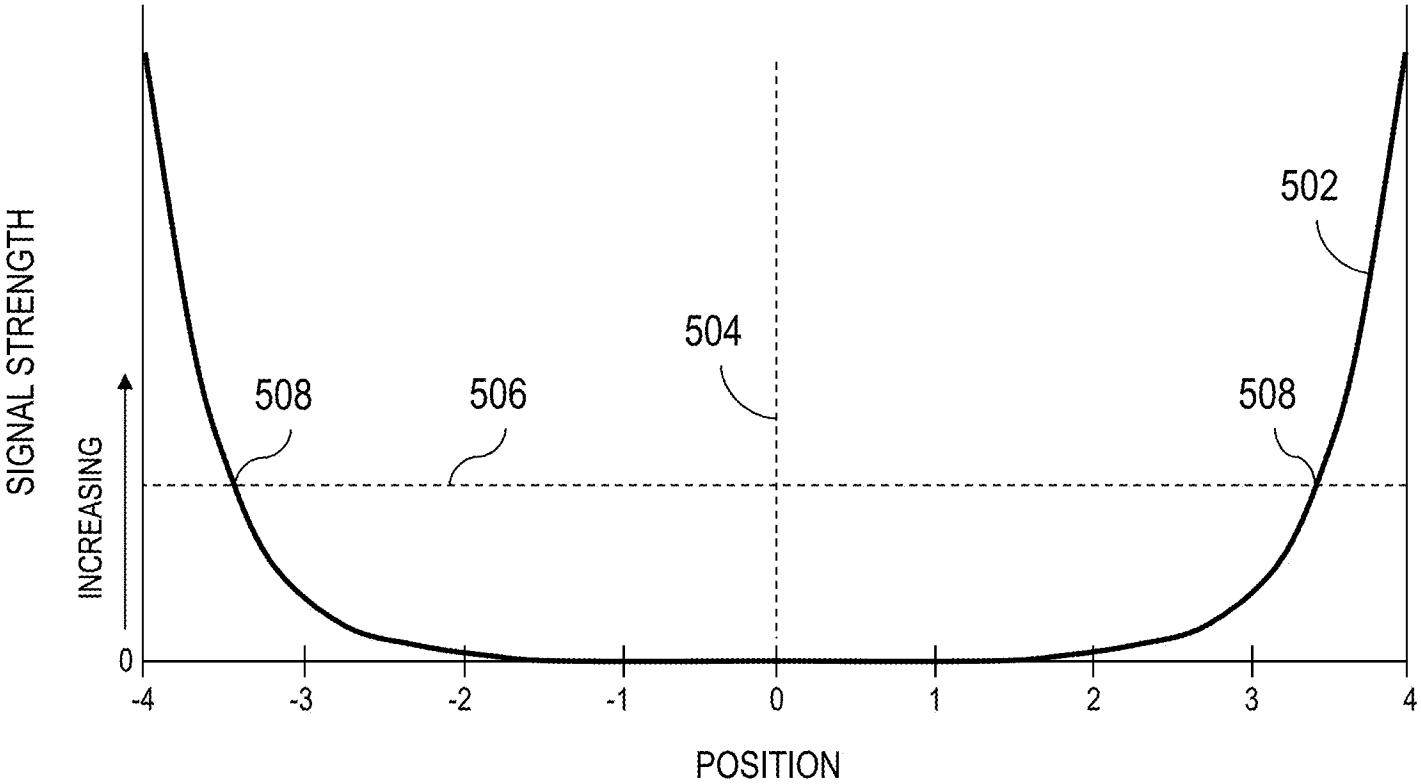
FIG. 5 is a graph depicting one or more aspects of the present disclosure.

FIG. 5 is a graph illustrating an example position-signal curve 502 generated from an output of the one or more sensors 352 shown in FIGS. 3 and 4 according to one or more aspects of the present disclosure. The amplitude of the signal generated by the sensor(s) 352 ("SIGNAL STRENGTH") is shown along the vertical axis, while the position of the piston 316 within the displacement unit 302 ("POSITION") is shown along the horizontal axis with unitless positions "−4" through "4." As can be seen from the graph, the position-signal curve 502 may be generally mirrored around a central vertical axis 504. Hence, the sensor signal alone may not be able to resolve the position of the piston 316 in the displacement unit 302. For example, most signal strength values (such as the example value 506) may correspond to two different positions 508 along the position-signal curve 502. Moreover, along a middle region of the position-signal curve 502, extending generally between positions "−2" and "2," the magnitude of the sensor signal may have such small variations that the piston position may not be accurately resolved, such that the determined piston position may be invalid. For these reasons, the sensor(s) 352 and/or other electronics may provide state information that indicates a region along the position-signal curve 502 in which the piston 316 is located, such as a first end region extending between positions "−4" and "−2," the middle region, and a second end region 514 extending between positions "2" and "4." The state information, along with the sensor signal, may be monitored by the system electronics 354 shown in FIGS. 3 and 4, for example.

Figure 6:
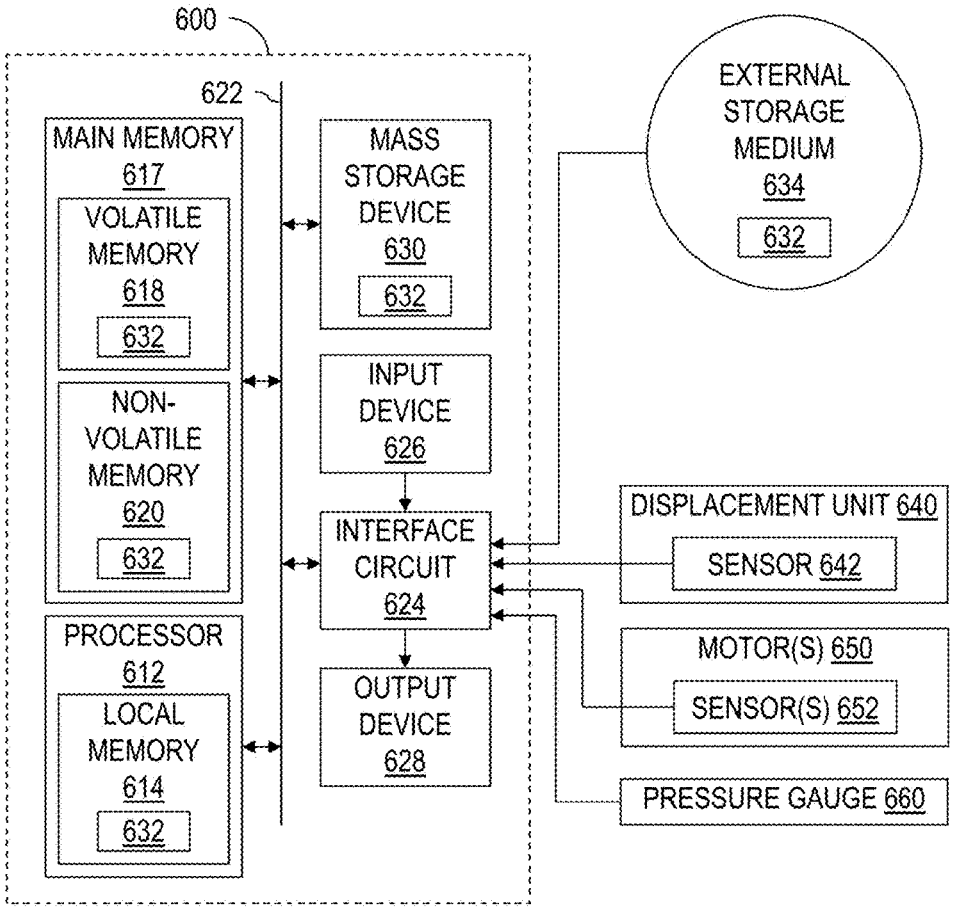
FIG. 6 is a schematic view of at least a portion of an example implementation of apparatus according to one or more aspects of the present disclosure.

FIG. 6 is a schematic view of at least a portion of an example implementation of a processing system 600 according to one or more aspects of the present disclosure. The processing system 600 may execute example machine-readable instructions to implement at least a portion of one or more of the methods and/or processes described herein, and/or to implement a portion of one or more of the example downhole tools described herein. The processing system 600 may be or comprise, for example, one or more processors, controllers, special-purpose computing devices, servers, personal computers, personal digital assistant (PDA) devices, smartphones, internet appliances, and/or other types of computing devices. Moreover, while it is possible that the entirety of the processing system 600 shown in FIG. 6 is implemented within downhole apparatus, such as the system electronics 354 and/or other downhole apparatus described above, one or more components or functions of the processing system 600 may also or instead be implemented in wellsite surface equipment, perhaps including the surface equipment 190 depicted in FIG. 1, the surface equipment 290 depicted in FIG. 2, and/or other surface equipment.

The processing system 600 may comprise a processor 612 such as, for example, a general-purpose programmable processor. The processor 612 may comprise a local memory 614, and may execute program code instructions 632 present in the local memory 614 and/or another memory device. The processor 612 may execute, among other things, machine-readable instructions or programs to implement the methods and/or processes described herein. The programs stored in the local memory 614 may include program instructions or computer program code that, when executed by an associated processor, cause a controller and/or control system implemented in surface equipment and/or a downhole tool to perform tasks as described herein. The processor 612 may be, comprise, or be implemented by one or more processors of various types operable in the local application environment, and may include one or more general-purpose processors, special-purpose processors, microprocessors, digital signal processors (DSPs), field-programmable gate arrays (FPGAs), application-specific integrated circuits (ASICs), processors based on a multi-core processor architecture, and/or other processors.

The processor 612 may be in communication with a main memory 617, such as via a bus 622 and/or other communication means. The main memory 617 may comprise a volatile memory 618 and a non-volatile memory 620. The volatile memory 618 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 620 may be, comprise, or be implemented by read-only memory, flash memory, and/or other types of memory devices. One or more memory controllers (not shown) may control access to the volatile memory 618 and/or the non-volatile memory 620.

The processing system 600 may also comprise an interface circuit 624. The interface circuit 624 may be, comprise, or be implemented by various types of standard interfaces, such as an Ethernet interface, a universal serial bus (USB), a third generation input/output (3GIO) interface, a wireless interface, and/or a cellular interface, among other examples. The interface circuit 624 may also comprise a graphics driver card. The interface circuit 624 may also comprise a communication device such as a modem or network interface card to facilitate exchange of data with external computing devices via a network, such as via Ethernet connection, digital subscriber line (DSL), telephone line, coaxial cable, cellular telephone system, and/or satellite, among other examples.

One or more input devices 626 may be connected to the interface circuit 624. One or more of the input devices 626 may permit a user to enter data and/or commands for utilization by the processor 612. Each input device 626 may be, comprise, or be implemented by a keyboard, a mouse, a touchscreen, a track-pad, a trackball, an image/code scanner, and/or a voice recognition system, among other examples.

One or more output devices 628 may also be connected to the interface circuit 624. One or more of the output device 628 may be, comprise, or be implemented by a display device, such as a liquid crystal display (LCD), a light-emitting diode (LED) display, and/or a cathode ray tube (CRT) display, among other examples. One or more of the output devices 628 may also or instead be, comprise, or be implemented by a printer, speaker, and/or other examples.

One or more of the sensors 352 described above and/or other sensors within the scope of the present disclosure may also be connected to the interface circuit 624. Reference number 652 designates such sensors in FIG. 6. In addition to the sensors 352 described above, the sensors 652 depicted in FIG. 6 may include a revolutions sensor, such as a tachometer associated with one or more motors 650. One or more of the motors 650 may be of the motor/pump assemblies 342, 344 depicted in FIGS. 3 and 4.

The processing system 600 may also comprise a mass storage device 630 for storing machine-readable instructions and data. The mass storage device 630 may be connected to the interface circuit 624, such as via the bus 622. The mass storage device 630 may be or comprise a floppy disk drive, a hard disk drive, a compact disk (CD) drive, and/or digital versatile disk (DVD) drive, among other examples. The program code instructions 632 may be stored in the mass storage device 630, the volatile memory 618, the non-volatile memory 620, the local memory 614, and/or on a removable storage medium 634, such as a CD or DVD.

The mass storage device 630, the volatile memory 618, the non-volatile memory 620, the local memory 614, and/or the removable storage medium 634 may each be a tangible, non-transitory storage medium. The modules and/or other components of the processing system 600 may be implemented in accordance with hardware (such as in one or more integrated circuit chips, such as an ASIC), or may be implemented as software or firmware for execution by a processor. In the case of firmware or software, the implementation can be provided as a computer program product including a computer readable medium or storage structure containing computer program code (i.e., software or firmware) for execution by the processor.

The following methods or processes may allow for determination of a flow rate of a fluid pumped by a displacement unit. The methods or processes are described in the context of devices and components described above, although in other implementations also within the scope of the present disclosure, methods or processes within the scope of this disclosure may be performed in the context of other devices and components. The methods or processes described below are presented in a given order, although other implementations also within the scope of the present disclosure may comprise the described and/or other methods or processes in other orders and/or parallel. Various other modifications to the methods or processes described below may also be consistent with the scope of the present disclosure. For example, such implementations may use different logic and/or calculations for different determinations, and/or may include additional or fewer determinations, computations, logic, monitoring, and/or other aspects.

A GMR and/or other sensor utilized for detecting piston position within a displacement unit, such as the sensor(s) 352, piston 316, and displacement unit 300 described above, may have a limited range of detection. Detection of the piston position outside of that range may not be sufficiently accurate or valid. The revolutions of a motor that drives a pump that pumps hydraulic fluid to drive the piston (such as the motor/pump assemblies 342, 344 depicted in FIGS. 3 and 4) may also be used to infer a piston position. Such inference may be valid over a full range of the piston movement, but is less accurate than the piston position sensor technique. The present disclosure introduces one or more aspects pertaining to leveraging aspects of both techniques, piston position determined using a sensor and piston position determined using a number of revolutions of a motor, which may then be used to determine a flow rate of the displacement unit that may be more accurate compared to using either technique independently.

The following description relates to methods and/or processes for determining a corrected flow rate of the downhole fluid pumped by the displacement unit. The corrected flow rate may be determined using the piston position data acquired as described above. That is, the piston position data is based on at least data and/or signals associated with a sensor (e.g., sensor 352) associated with the displacement unit, such as a GMR sensor, that is capable of generating an output signal that is dependent upon a physical position of the piston, and on at least data and/or signals associated with a motor that indicates a number of revolutions of the motor that causes hydraulic fluid to be pumped to the displacement unit to drive the piston of the displacement unit. This data and/or signal(s) is sampled at data sampling times.

During a stroke of the piston, piston position data based on the sensor (hereinafter, "$Lp^{Sen}$") can be determined based on the sampled data from the sensor, and piston position data based on the motor revolutions (hereinafter, "$Lp^{Rev}$") can also be determined based on the sampled data associated with the motor. An estimated instantaneous flow rate of the fluid pumped by the displacement unit can be determined using a difference between the piston position $Lp^{Rev}$ at a current data sampling time and the piston position $Lp^{Rev}$ at an immediately previous data sampling time. This difference can be multiplied by a known surface area of the piston (e.g., the surface perpendicular to the movement of the piston during the stroke) and a pump volume efficiency metric that accounts for inefficiency in the hydraulic system, such as may be caused by leaks in the system, and differences in efficiencies based on stroke directions, among other parameters. The product of this multiplication can be divided by the time between the two instances of sampling the data to achieve the estimated instantaneous flow rate.

A correction factor (referred to herein as a "total correction factor") can be generated to adjust the estimated instantaneous flow rate. The total correction factor may account for differences between piston position data $Lp^{Rev}$ and piston position data $Lp^{Sen}$, such as by including consideration of a piston position correction factor and a stroke volume correction factor. The adjusted instantaneous flow rate may be determined by multiplying the estimated instantaneous flow rate by the total correction factor.

The following description also relates to methods and/or processes for determining other information, such as corrected continuous volume of the downhole fluid pumped by the displacement unit, quality indications, or the like. A corrected continuous volume may be updated at each data sampling time or at the completion of a stroke. Two different corrected continuous volumes may be determined, including one that is updated at each data sampling time, and another that is updated at the completion of a stroke. The corrected continuous volume that is updated at each data sampling time is determined by summing a corrected instantaneous stroke volume of the current stroke with a corrected stroke volume of previous strokes. The corrected instantaneous stroke volume is determined by multiplying the surface area of the piston, the pump volume efficiency metric, the total correction factor, and the difference between the piston position $Lp^{Rev}$ at a current data sampling time and the piston position $Lp^{Rev}$ at the data sampling time that the stroke starts. When the data sampling time is when the stroke ends, the corrected instantaneous stroke volume is a corrected stroke volume for that stroke. The corrected continuous volume that is updated at the completion of a stroke is determined by summing a corrected stroke volume of the current stroke and a corrected continuous volume that was updated at the completion of the previous stroke. Depending upon conditions under which the current stroke was completed, the corrected stroke volume may be determined by multiplying the surface area of the piston and the difference between the piston position $Lp^{Sen}$ at the data sampling time that the stroke ends and the piston position $Lp^{Sen}$ at the data sampling time that the stroke starts, or by multiplying the surface area of the piston, the pump volume efficiency metric, the total correction factor, and the difference between the piston position $Lp^{Rev}$ at the data sampling time that the stroke ends and the piston position $Lp^{Rev}$ at the data sampling time that the stroke starts.

Figure 7:
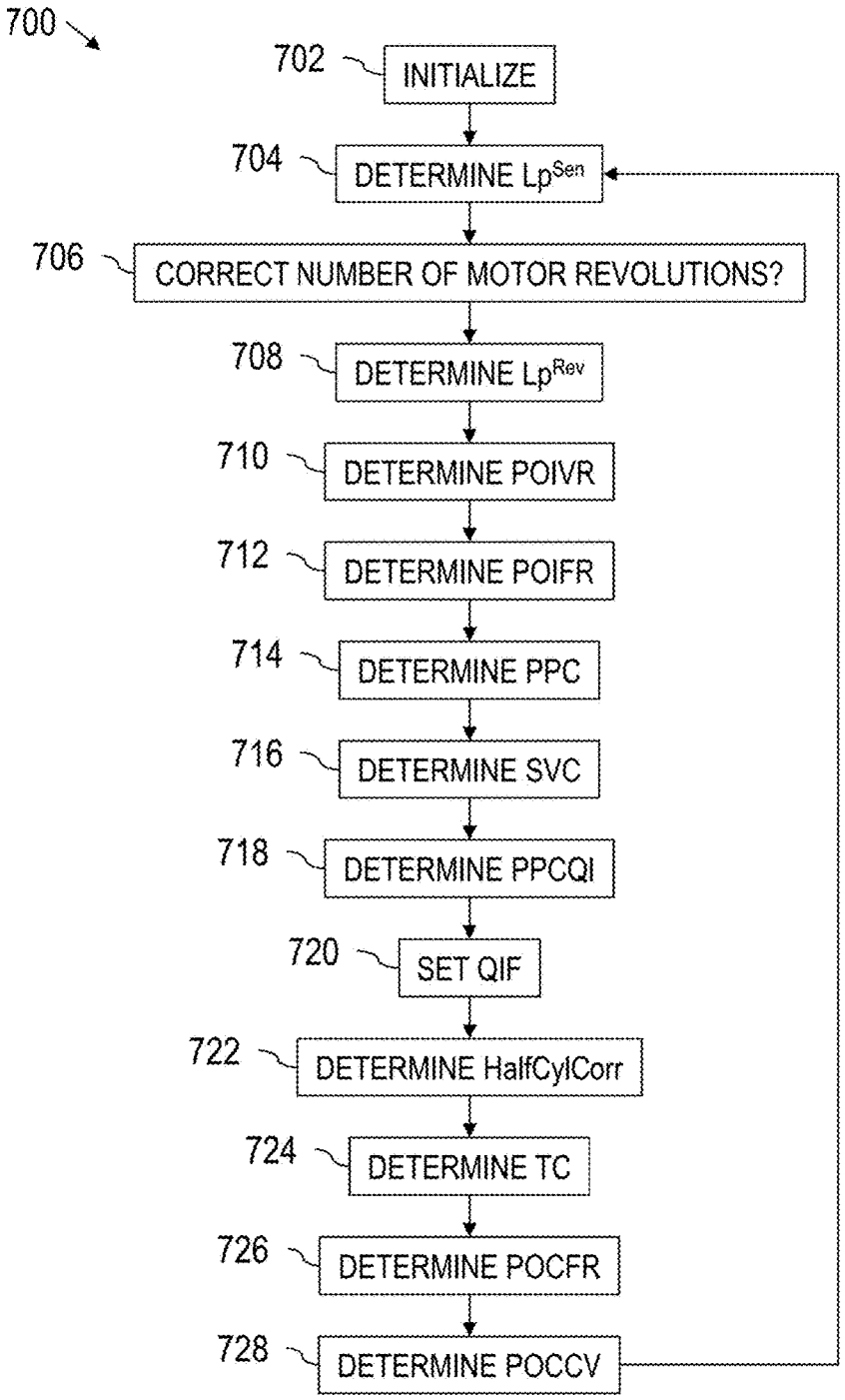
FIG. 7 is a flow-chart diagram of at least a portion of an example implementation of a method according to one or more aspects of the present disclosure.

FIG. 7 is a flow-chart diagram of at least a portion of an example implementation of a method (700) for determining a flow rate of a pumped fluid according to one or more aspects of the present disclosure. The method (700) may also determine other information, such as a continuous volume of the pumped fluid.

The method (700) may include initializing (702) a processing system and components of a downhole sampling tool, such as a processing system and downhole sampling tool according to one or more aspects described above. The initialization (702) may also include the input of user-defined into the processing system, such as whether certain actions are enabled, as described below. The initialization (702) may also include calibrating the processing system with components of the downhole sampling tool. For example, such calibration may be between the number of revolutions of a given motor (e.g., motor/pump assembly(ies) 342, 344) and a corresponding displacement of the piston (e.g., piston 316) in the displacement unit (e.g., displacement unit 302). The initialization (702) may also utilize a look-up table correlating an output of a sensor (e.g., sensor 352, which may be a GMR sensor) associated with the displacement unit with the position of the piston of the displacement unit. Other aspects may also be initialized, input, and/or calibrated.

A piston position $Lp^{Sen}$ in a stroke is determined (704) based on the sensor output. The piston position $Lp^{Sen}$ may be determined (704) by correlating the output of the sensor with a known function. For example, determining (704) the piston position $Lp^{Sen}$ may utilize the above-described look-up table that indicates the piston position for a given output of the sensor.

The method (700) may also include determining (706) whether to correct a number of motor revolutions (subsequently utilized to determine a piston position $Lp^{Rev}$ based on the number of motor revolutions) based on hydraulic over-pressure. If such correction is enabled and an over-pressure condition exists in the hydraulic system (e.g., in the hydraulic circuit 356 shown in FIGS. 3 and 4), a relief valve in the hydraulic system may release hydraulic fluid, such that the hydraulic system is not driving the piston in the displacement unit although the motor(s) may continue to operate to pump the hydraulic fluid. In such a situation, the number of motor revolutions may not be indicative of the piston position. If correction is to be made, the corrected number of motor revolutions may be assigned to be equal to the corrected number of motor revolutions at a previous data sampling time, such as the immediately preceding data sampling time. Otherwise, the corrected number of motor revolutions may be the sum of the corrected number of motor revolutions at a previous data sampling time, such as the immediately preceding data sampling time, and the difference between the number of motor revolutions at the current data sampling time and the number of motor revolutions at the previous data sampling time.

The method (700) also includes determining (708) the piston position $Lp^{Rev}$. For example, the $LP^{Rev}$ may be determined (708) by using the sensed (or perhaps corrected (706)) number of motor revolutions and a linear or other function that indicates the piston position $Lp^{Rev}$ as a function of the number of motor revolutions.

The pumped out instantaneous volume rate POIVR of the displacement unit may then be determined (710) using the piston position $Lp^{Rev}$. The POIVR may be determined (710) as the product of the surface area of the piston (e.g., perpendicular to the movement of the piston), a pump volume efficiency metric, and the difference between the piston position $Lp^{Rev}$ at the current data sampling time and the piston position $Lp^{Rev}$ at a previous data sampling time, such as the immediately preceding data sampling time. The pump volume efficiency metric may be a metric determined during initialization (702) that corresponds to how efficiently the pumping of hydraulic fluid to the displacement unit corresponds to movement of the piston. For example, leakage in the hydraulic system, compression of the fluid, and differences in stroke direction, among other factors, may cause the piston to not move as much as the number of motor revolutions might indicate, which may be accounted for by the pump volume efficiency metric.

The pumped out instantaneous flow rate POIFR of the displacement unit may then be determined (712). The POIFR may be determined (712) by dividing the POIVR by the amount of time between the current data sampling time and the previous data sampling time used to determine (710) the POIVR.

A piston position correction factor (PPC) may then be determined (714). The PPC may assume that the piston positions $Lp^{Rev}$ and $Lp^{Sen}$ may each be a linear function of time, e.g., $Lp^{Rev}=m_{rev}*t$ and $Lp^{Sen}=m_{sen}*t$, wherein $m_{rev}$ and $m_{sen}$ are slopes of the linear functions relating the respective $Lp^{Rev}$ and $Lp^{Sen}$ to operating/running time t. As described above, the sensor output may not be valid over a full movement of the piston, so the PPC may be determined as a ratio of the slopes of the linear functions over a valid range of $Lp^{Sen}$ to correct $Lp^{Rev}$, and calculations based thereon, over the full movement range of the piston. For example, to obtain a hypothetical piston position $Lp^{Sen}$ over a full movement range of the piston from the piston position $Lp^{Rev}$, the piston position $Lp^{Rev}$ would be multiplied by a PPC $m_{sen}/m_{rev}$.

A stroke volume correction factor SVC may then be determined (716). For example, if the stroke has completed, the SVC may be determined (716) as the ratio of a sensor-based stroke volume SSV to an integrated stroke volume ISV. The SSV may be the product of the surface area of the piston and the difference between the piston position $Lp^{Sen}$ at the end of the stroke and the piston position $Lp^{Sen}$ at the beginning of the stroke. The ISV may be a summation of products of the PPC and the POIVR at each data sampling time during the stroke. If the stroke has not completed, determining (716) the SVC for the stroke may include setting the SVC equal to the SVC of a previous stroke, such as the immediately preceding stroke.

After the stroke has completed, a PPC quality index PPCQI may be determined (718), and a corresponding flag QIF may be set (720). PPCQI may be a percentage that the ISV deviates from the SSV. If PPCQI is determined (718) to be within a predetermined threshold, the set (720) QIF may indicate that the PPC is sufficiently accurate. If PPCQI is determined (718) to not be within the predetermined threshold, the set (720) QIF may indicate that the PPC is not sufficiently accurate.

A half-cycling factor HalfCylCorr may then be determined (722). If half-cycling correction is enabled and is occurring at the current data sampling time, determining (722) HalfCylCorr may include setting HalfCylCorr to one or a logical true. Otherwise, determining (722) HalfCylCorr may include setting HalfCylCorr to zero or a logical false.

A total correction factor TC may then be determined (724). Determining (724) TC may include determining a product of HalfCylCorr, PPC, and SVC. Determining (724) TC may instead include determining a product of PPC and SVC when HalfCylCorr is a logical true, and setting TC to be zero when HalfCylCorr is a logical false.

A pumped out corrected flow rate POCFR may then be determined (726). For example, determining (726) POCFR may include determining a product of POIFR and TC.

A pumped out corrected continuous volume POCCV may then be determined (728). POCCV may be updated with each data sampling time or with each stroke. In some implementations, a first POCCV may be updated each data sampling time, and a second POCCV may be updated after each stroke. Determining (728) the POCCV that is updated each data sampling time may include determining the sum of a corrected stroke volume of a current stroke and the corrected stroke volume of previous strokes. The corrected stroke volume of the current stroke may be a product of the surface area of the piston, the pump volume efficiency metric, the TC, and a difference between the piston position $Lp^{Rev}$ at the current data sampling time and the piston position $Lp^{Rev}$ at the beginning of the current stroke. Determining (728) the POCCV after each stroke may include determining the corrected stroke volume for that stroke.

Determining (728) the POCCV updated per stroke may be based on the conditions of the current stroke. For example, if the current stroke has not completed, the POCCV updated each stroke may be set equal to the POCCV updated at the completion of the previous stroke. If the current stroke has completed, the POCCV updated each stroke may be the sum of a corrected stroke volume of a current stroke and the corrected stroke volume of previous strokes. If the current stroke is completed under a given condition, such as a normal completion of the stroke, the corrected stroke volume of the current stroke may be a product of the surface area of the piston and a difference between the piston position $Lp^{Sen}$ at the end of the stroke and the piston position $Lp^{Sen}$ at the beginning of the stroke. If the current stroke completed under a different condition, the corrected stroke volume of the current stroke may be a product of the surface area of the piston, the pump volume efficiency metric, the TC, and a difference between the piston position $Lp^{Rev}$ at the end of the current stroke and the piston position $Lp^{Rev}$ the beginning of the current stroke.

The method (700) may be repeated while operation of the displacement unit continues. For example, such iterations may begin with the determination (704) of the piston position $Lp^{Sen}$.

FIGS. 8-14 are flow-chart diagrams of at least respective portions of example workflows for determining a flow rate and/or volume of a fluid pumped out by a displacement unit according to one or more aspects of the present disclosure. Each of FIGS. 8-14 provide example details of one or more aspects of the method (700) of FIG. 7. In the following description of FIGS. 8-14, index i refers to a current data sampling time, which also corresponds to a current iteration of the loop in the method (700) of FIG. 7. Thus, index i−1 refers to the data sampling time immediately preceding the current data sampling time. Index j, either as a subscript or vector index, refers to a current stroke on which data is being processed. Thus, index j−1 refers to the stroke immediately preceding the current stroke. The following description is also presented in the context of a GMR sensor, with the understanding that one or more aspects described below are similarly applicable or readily adapted for implementations utilizing other types of sensors.

Figure 8:
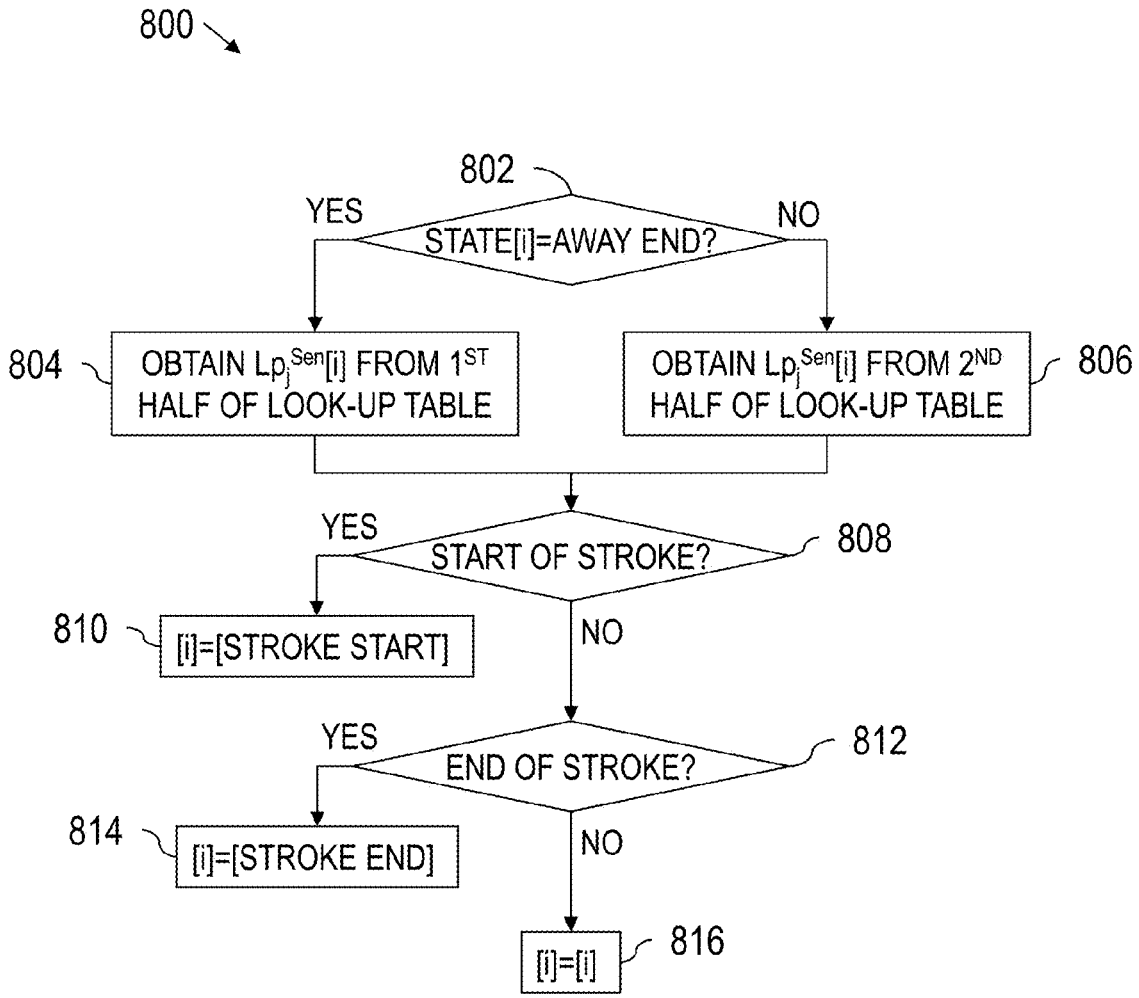
FIG. 8 is a flow-chart diagram of at least a portion of an example implementation of a method according to one or more aspects of the present disclosure.

FIG. 8 is a flow-chart diagram of at least a portion of an example implementation of a method (800) for determining $Lp_j^{Sen}$[i], which is the piston position $Lp^{Sen}$ at the current data sampling time i for the current stroke j. That is, the method (800) may be utilized for determining (704) the current piston position $Lp^{Sen}$ shown in FIG. 7 for the current data sampling time i and stroke j.

As described above with respect to FIG. 5, the output signal of a GMR sensor may be mirrored around a vertical axis, and hence, in some instances, the position of the piston may not be able to be resolved based on the output signal of the GMR sensor alone. However, the GMR sensor also outputs current state information STATE[i] that indicates which half of the output signal corresponds to the piston position, which permits the piston position to be resolved. A look-up table is also maintained that correlates the output signal with the piston position. For example, one half of the look-up table may correspond to a first half of the mirrored output signal, and the other half of the look-up table may correspond to a second half of the mirrored output signal.

The method (800) includes determining (802) whether the current state information STATE[i] indicates that the piston is moving away from the highest signal output AWAY END. If so, the piston position $Lp_j^{Sen}$[i] is obtained (804) by identifying the position data corresponding to the output signal of the GMR sensor in the first half of the look-up table. If not, the piston position $Lp_j^{Sen}$[i] is obtained (806) by identifying the position data corresponding to the output signal of the GMR sensor in the second half of the look-up table.

The method (800) also includes determining (808) whether the piston position $Lp_j^{Sen}$[i] is the start of the current stroke. If so, the piston position at the beginning of the current stroke $Lp_j^{Sen}$[stroke start] is set (810) equal to the obtained (804, 806) piston position $Lp_j^{Sen}$[i]. If not, the method (800) includes determining (812) whether the obtained (804, 806) piston position $Lp_j^{Sen}$[i] is the end of the current stroke. If so, the piston position at the end of the current stroke $Lp_j^{Sen}$[stroke end] is set (814) equal to the obtained (804, 806) piston position $Lp_j^{Sen}$[i]. If not, the current piston position $Lp_j^{Sen}$[i] is utilized (816) moving forward with other portions of the method (700) of FIG. 7.

The start and end of a given stroke may be determined by monitoring various conditions in the pump-out module. For example, actuation of various solenoid valves (e.g., solenoid valves SOL1-SOL3) and/or a poppet valve network (e.g., poppet valve network 350) within the hydraulic system can indicate a change of direction of the piston in the displacement unit, and can therefore indicate when a stroke starts or ends. Additionally, controller information or commands (e.g., from system electronics 354) can be monitored to determine when that information or commands indicate a start or end of a stroke.

Figure 9:
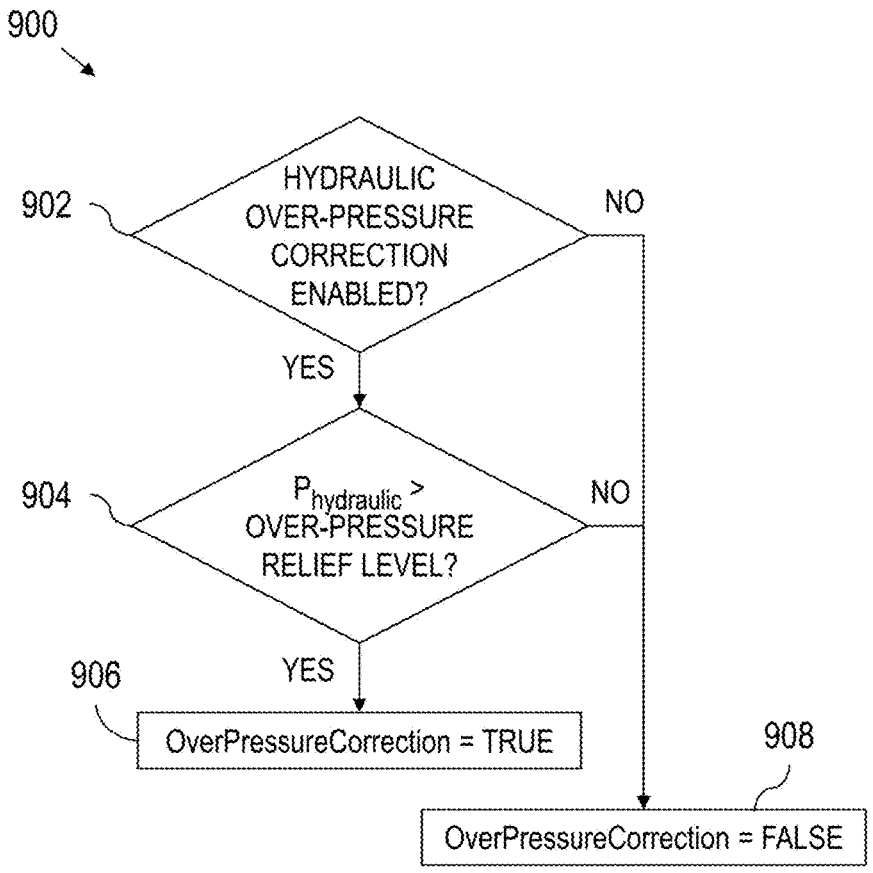
FIG. 9 is a flow-chart diagram of at least a portion of an example implementation of a method according to one or more aspects of the present disclosure.

FIG. 9 is a flow-chart diagram of at least a portion of an example implementation of a method (900) for determining whether to correct the piston position $Lp_j^{Rev}$[i] for hydraulic over-pressure, as described above with regard to the correction determination (706) depicted in FIG. 7. The method (900) includes determining (902) whether hydraulic over-pressure correction is enabled. If the hydraulic over-pressure correction is enabled, the hydraulic pressure of the displacement unit $P_{hydraulic}$ is compared (904) to a predetermined over-pressure relief level. If the hydraulic pressure $P_{hydraulic}$ is greater than the predetermined over-pressure relief level, an over-pressure correction indicator OverPressureCorrection is set (906) to TRUE. If the hydraulic over-pressure correction is not enabled, or if the hydraulic pressure $P_{hydraulic}$ is not greater than the predetermined over-pressure relief level, OverPressureCorrection is set (908) to FALSE. In this way, the method (900) determines when a hydraulic over-pressure condition exists, at which time hydraulic fluid is released back to a hydraulic fluid reservoir to relieve the over-pressure condition, rather than driving the piston in the displacement unit, although the motor(s) may continue to operate.

Figure 10:
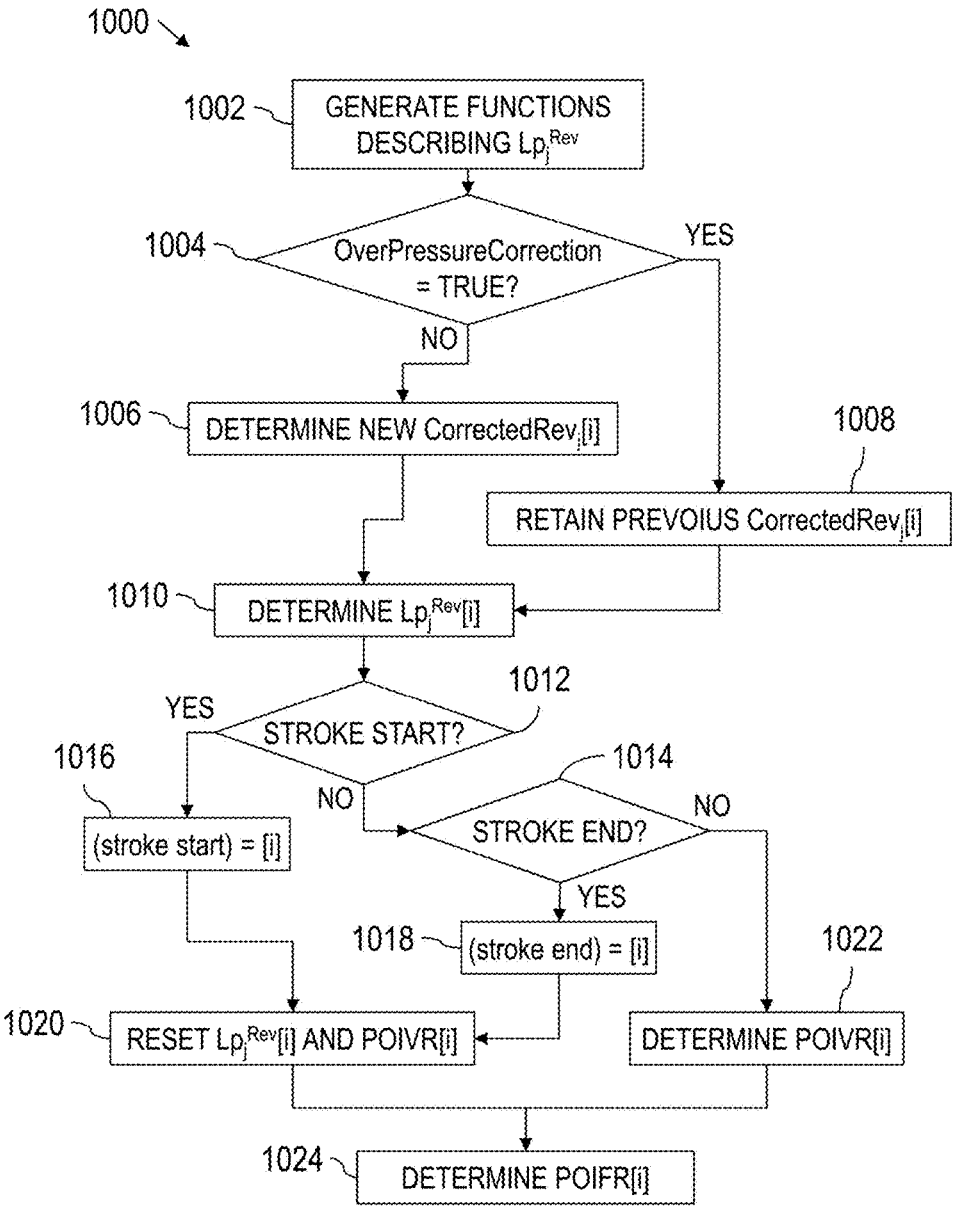
FIG. 10 is a flow-chart diagram of at least a portion of an example implementation of a method according to one or more aspects of the present disclosure.

FIG. 10 is a flow-chart diagram of at least a portion of an example implementation of a method (1000) for determining the piston position $Lp_j^{Rev}$[i], POIVR, and POIFR, as described above with regard to these determinations (708, 710, 712) depicted in FIG. 7. The method (1000) includes generating (1002) linear and/or other functions based on coefficients that are determined during calibration, for example. The functions can be used to determine an estimated position of the piston position $Lp_j^{Rev}$ using an amount of hydraulic fluid that is pumped to the piston, as indicated by revolutions of a motor, including different combinations of multiple motors.

The method (1000) may also include determining (1004) whether OverPressureCorrection is TRUE or FALSE, as described above with respect to FIG. 9. If OverPressureCorrection is FALSE, the corrected revolutions for the stroke j at the current data sampling time i, $CorrectedRev_j$[i], is set (1006) equal to the corrected revolutions for the stroke j at the immediately preceding data sampling time i−1, $CorrectedRev_j$[i−1], plus the difference between the revolutions input at the current data sampling time, RevIn[i], and the revolutions input at the immediately preceding data sampling time, RevIn[i−1], as set forth below in Equation (1).

$$CorrectedRev_j[i]=CorrectedRev_j[i-1]+(RevIn[i]-RevIn[i-1]) \quad \text{Eq. (1)}$$

The revolutions input RevIn at each data sampling time is the accumulated revolutions during operation up to that data sampling time. If OverPressureCorrection is TRUE, the corrected revolutions $CorrectedRev_j$[i] is set (1008) equal to the corrected revolutions $CorrectedRev_j$[i−1], as set forth below in Equation (2).

$$CorrectedRev_j[i]=CorrectedRev_j[i-1] \quad \text{Eq. (2)}$$

The piston position $Lp_j^{Rev}$[i] is then determined (1010) using the corrected (1006, 1008) revolutions $CorrectedRev_j$[i] and the generated (1002) functions. The determination (1010) may include inputting the corrected revolutions Corrected $Rev_j$ [i] into the appropriate function (1002), such as based on which one or more motors are causing hydraulic fluid to be pumped to the displacement unit.

The method (1000) also includes determining (1012) whether the piston is at the start of a stroke, and determining (1014) whether the piston is at the end of a stroke, as described above with respect to FIG. 8, and/or by monitoring various conditions in the displacement unit. For example, actuation of ones of the solenoid valves SOL1-SOL3 and/or the poppet valve network 350 can indicate a change of direction of the piston, and can therefore also indicate when a stroke starts or ends. Additionally, controller information or commands (e.g., from system electronics 354) can be monitored to determine when that information or commands indicate a start or end of a stroke. If the stroke is determined (1012) to be at its start, the piston position for the beginning of the current stroke j, $Lp_j^{Rev}$ (stroke start), is set (1016) equal to the current piston position $Lp_j^{Rev}[i]$. If the stroke is determined (1014) to be at its end, the piston position for the end of the current stroke, $Lp_j^{Rev}$ (stroke end), is set (1018) equal to the current piston position $Lp_j^{Rev}$ [i]. Each of the piston position $Lp_j^{Rev}[i]$ and the POIVR at the current data sampling time i, POIVR[i], is then reset (1020) to zero.

If the stroke is determined (1012) not to be at its start, as is also determined (1014) not to be at its end, the instantaneous volume rate POIVR[i] is determined (1022) utilizing Equation (3) set forth below.

$$\text{POIVR}[i]=\text{PistonArea}*(Lp_j^{Rev}[i]-Lp_j^{Rev}[i-1])*\text{PVE}[i] \quad \text{Eq. (3)}$$

where PistonArea is the surface area of the piston (e.g., the surface perpendicular to the movement of the piston during the stroke), and PVE[i] is a pump volume efficiency metric for the current data sampling time i. The pump volume efficiency metric PVE[i] accounts for inefficiency in the hydraulic system at the current data sampling time, such as may be caused by leaks in the system and differences in efficiencies based on stroke directions, among other possible factors.

The POIFR at the current data sampling time is then determined (1024) utilizing Equation (4) set forth below.

$$\text{POIFR}[i]=\text{POIFV}[i]/\Delta t \quad \text{Eq. (4)}$$

where Δt is the difference in time between the current data sampling time i and the immediately preceding data sampling time i−1.

Figure 11:
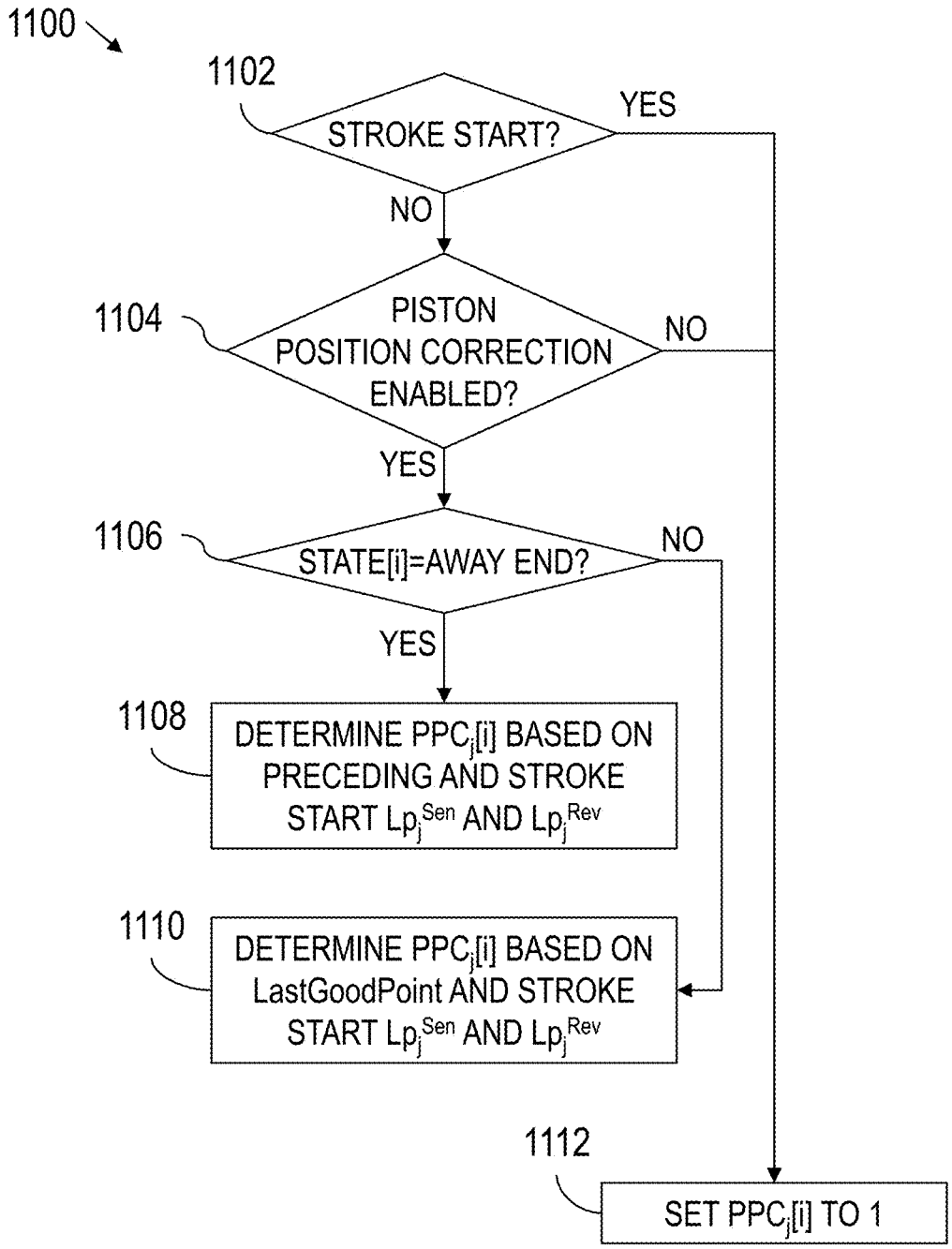
FIG. 11 is a flow-chart diagram of at least a portion of an example implementation of a method according to one or more aspects of the present disclosure.

FIG. 11 is a flow-chart diagram of at least a portion of an example implementation of a method (1100) for determining $PPC_j[i]$, a piston position correction factor for the stroke j at the current data sampling time i, as described above with respect to the PPC determination (714) depicted in FIG. 7. The method (1100) includes determining (1102) whether the stroke is at its start and/or determining (1104) whether piston position correction is enabled. The start of a given stroke may be determined (1102) as described above with respect to FIG. 8 and/or by monitoring various conditions in the displacement unit. For example, actuation of one or more of the solenoid valves SOL1-SOL3 and/or the poppet valve network 350 within the hydraulic system can indicate a change of direction of the piston in the displacement unit, and can therefore indicate when a stroke starts. Additionally, controller information or commands (e.g., from system electronics 354) can be monitored to determine when that information or commands indicate a start of a stroke. The piston position correction enabling can be user input that is input during initialization of the system, such as during the initialization (702) depicted in FIG. 7. If the stroke is determined (1102) to be at its start, or if piston position correction is determined (1104) to not be enabled, $PPC_j[i]$ is set (1112) equal to one.

If the stroke is determined (1102) to not be at its start and piston position correction is determined (1104) to be enabled, the method (1100) includes determining (1106) whether STATE[i], the sensor state information at the current data sampling time i, indicates that the piston is moving away from the highest signal output, AWAY END. As described above with respect to FIG. 5, STATE[i] indicates the region (e.g., first end region, middle region, or second end region) in which the piston is located at data sampling time i. For example, if STATE[i] is AWAY END, the piston may be within the middle or other region of the stroke in which the position sensor output is less likely to indicate a valid and/or accurate piston position, while if STATE[i] is not AWAY END (e.g., NEAR END), the piston may be within one of the end regions and/or another region of the stroke in which the position sensor output is more likely to indicate a valid and/or accurate piston position.

If STATE [i] is determined (1106) to be AWAY END, $PPC_j[i]$ is determined (1108) utilizing Equation (5) set forth below.

$$PPC_j[i] = \frac{Lp_j^{Sen}[i-1] - Lp_j^{Sen}(\text{STROKE START})}{Lp_j^{Rev}[i-1] - Lp_j^{Rev}(\text{STROKE START})} \quad \text{Eq. (5)}$$

where $Lp_j^{Sen}$(STROKE START) is $Lp_j^{Sen}$ at the start of the stroke, and $Lp_j^{Rev}$ (STROKE START) is $Lp_j^{Rev}$ at the start of the stroke.

If STATE [i] is determined (1106) to not be AWAY END, $PPC_j[i]$ is determined (1110) utilizing Equation (6) set forth below.

$$PPC_j[i] = \frac{Lp_j^{Sen}[LastGoodPoint] - Lp_j^{Sen}(\text{STROKE START})}{Lp_j^{Rev}[LastGoodPoint] - Lp_j^{Rev}(\text{STROKE START})} \quad \text{Eq. (6)}$$

where $Lp_j^{Sen}$(LastGoodPoint) and $L_j^{Sen}$(LastGoodPoint) are, respectively, $Lp_j^{Sen}$ and $Lp_j^{Rev}$ at the last good sampling time. LastGoodPoint for a given $Lp_j^{Sen}$ and $Lp_j^{Rev}$ may be determined as the $Lp_j^{Sen}$ and $Lp_j^{Rev}$ at the data sampling time immediately preceding a transition of STATE from AWAY END to not AWAY END. For example, if STATE[i−1] is AWAY END and STATE[i] is not AWAY END, then $Lp_j^{Sen}$ (LastGoodPoint) may be $Lp_j^{Sen}[i-1]$ and $Lp_j^{Rev}$(LastGoodPoint) may be $Lp_j^{Rev}[i-1]$.

Consistent with the above description with respect to FIG. 7, the logic and determinations in the method (1100) of FIG. 11 determine $PPC_j[i]$ as a ratio of slopes of the linear and/or other functions of $Lp_j^{Rev}$ and $Lp_j^{Sen}$ through the valid region of the position sensor output near the start of each stroke j. After the piston enters an invalid region of the position sensor output, the ratio is set for the remainder of the stroke j.

Figure 12:
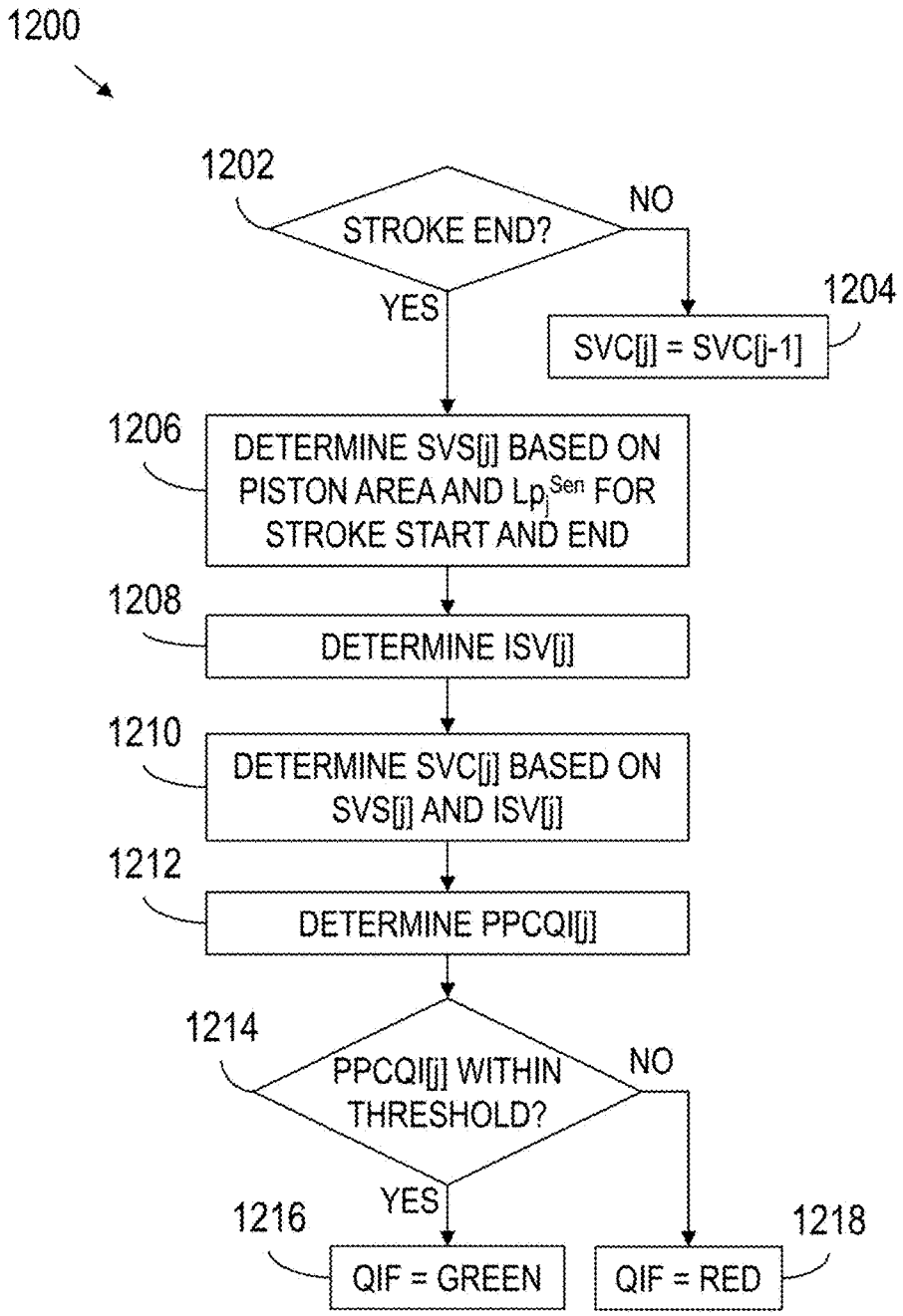
FIG. 12 is a flow-chart diagram of at least a portion of an example implementation of a method according to one or more aspects of the present disclosure.

FIG. 12 is a flow-chart diagram of at least a portion of an example implementation of a method (1200) for determining SVC[j], PPCQI[j], and the QIF, as described above with respect to the SVC determination (716), the PPCQI determination (718), and QIF setting (720) depicted in FIG. 7. SVC[j] and PPCQI[j] are, respectively, the SVC and PPCQI for the current stroke j.

The method (1200) includes determining (1202) whether the stroke has ended, such as described above with respect to FIG. 8 and/or by monitoring various conditions in the displacement unit. For example, actuation of one or more of the solenoid valves SOL1-SOL3 and/or the poppet valve network 350 can indicate a change of direction of the piston, and can therefore indicate when a stroke ends. Additionally, controller information or commands (e.g., from system electronics 354) can be monitored to determine when that information or commands indicate an end of a stroke. If the stroke is determined (1202) not to have ended, SVC[j] is set (1204) equal to SVC[j−1], which is the SVC for the immediately preceding stroke j−1.

If the stroke is determined (1202) to have ended, SVS[j], which is the SVS for the current stroke j, is determined (1206) utilizing Equation (7) set forth below.

$$SVS[j]=PistonArea*[Lp_j^{Sen}(STROKE\ END)-Lp_j^{Sen}(STROKE\ START)] \quad \text{Eq. (7)}$$

where $Lp_j^{Sen}$(STROKE END) is $Lp_j^{Sen}$ at the end of the stroke.

ISV[j], which is the ISV for the current stroke j, is then determined (1208) utilizing Equation (8) set forth below.

$$ISV[j]=\Sigma_{n=i(stroke\ j\ start)}^{i(stroke\ j\ end)}(PPC_j[n]\times POIVR_j[n]) \quad \text{Eq. (8)}$$

where n is the index to the data sampling time between stroke j start and stroke j end.

SVC[j], which is the SVC for the current stroke j, is then determined (1210) utilizing Equation (9) set forth below.

$$SVC[j]=SVS[j]/ISV[j] \quad \text{Eq. (9)}$$

PPCQI[j], which is the PPCQI for the current stroke j, is then determined (1212) utilizing Equation (10) set forth below.

$$PPCQI[j]=\frac{|SVS[j]-ISV[j]|}{SVS[j]} \quad \text{Eq. (10)}$$

PPCQI[j] is then compared (1214) to a predetermined threshold. The predetermined threshold may be five percent, although other amounts may be used in other implementations. If PPCQI[j] is determined (1214) to be within the predetermined threshold, the QIF may be set (1216) to "green" or some other color indicating that the instances of $PPC_j$[i] for the stroke j are sufficiently accurate. If PPCQI[j] is determined (1214) to not be within the predetermined threshold, the QIF may be set to "red" or some other color indicating that the instances of $PPC_j$[i] for the stroke j are not sufficiently accurate. For example, a "red" QIF may indicate that the GMR sensor may need to be recalibrated, that sanding issues exist, and/or other issues. A "red" QIF may also trigger PPC and/or SVC enablement changes.

Figure 13:
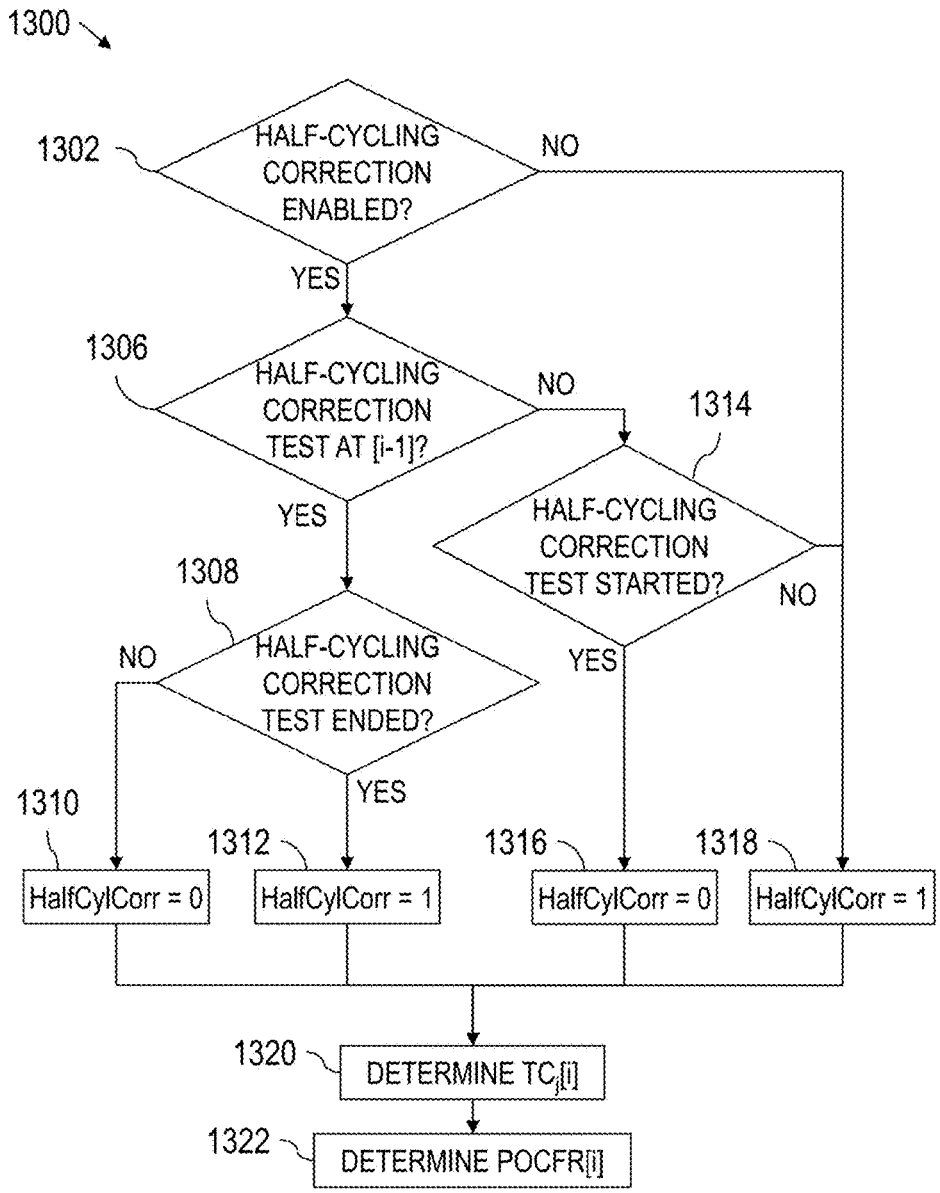
FIG. 13 is a flow-chart diagram of at least a portion of an example implementation of a method according to one or more aspects of the present disclosure.

FIG. 13 is a flow-chart diagram of at least a portion of an example implementation of a method (1300) for determining HalfCylCorr, $TC_j$[i], and POCFR[i], as described above with respect to the HalfCylCorr determination (722), the TC determination (724), and the POCFR determination (726) depicted in FIG. 7. $TC_j$[i] is the TC for the current stroke j and data sampling time i, and POCFR[i] is the POCFR for the current data sampling time i.

The method (1300) includes determining (1302) whether half-cycling correction is enabled. Whether half-cycling correction is enabled may be a user input that is input during initialization of the system, such as during the initialization (702) depicted in FIG. 7. If half-cycling correction is determined (1302) to not be enabled, HalfCylCorr is set (1304) to one.

The method (1300) also includes determining (1306) whether half-cycling correction testing was performed at the immediately preceding data sampling time i−1. If half-cycling correction is determined (1302) as being enabled, and half-cycling correction testing was determined (1306) to have been performed at the immediately preceding data sampling time i−1, there is a determination (1308) as to whether the half-cycling correction test has ended. If the half-cycling correction test is determined (1308) to have not ended, HalfCylCorr is set (1310) to zero. If the half-cycling correction test is determined (1308) to have ended, HalfCylCorr is set (1312) to one.

If half-cycling correction is determined (1306) as having not been performed at the immediately preceding data sampling time i−1, there is a determination (1314) as to whether the half-cycling correction test has started. If the half-cycling correction test is determined (1314) to have started, HalfCylCorr is set (1316) to zero. If the half-cycling correction test is determined (1314) as not yet started, HalfCylCorr is set (1318) to one.

$TC_j$[i] is then determined (1320) utilizing Equation (11) set forth below.

$$TC_j[i]=PPC_j[i]*SVC[j]*HalfCylCorr \quad \text{Eq. (11)}$$

POCFR[i] is then determined (1322) utilizing Equation (12) set forth below.

$$POCFR[i]=POIFR[i]*TC_j[i] \quad \text{Eq. (12)}$$

Figure 14:
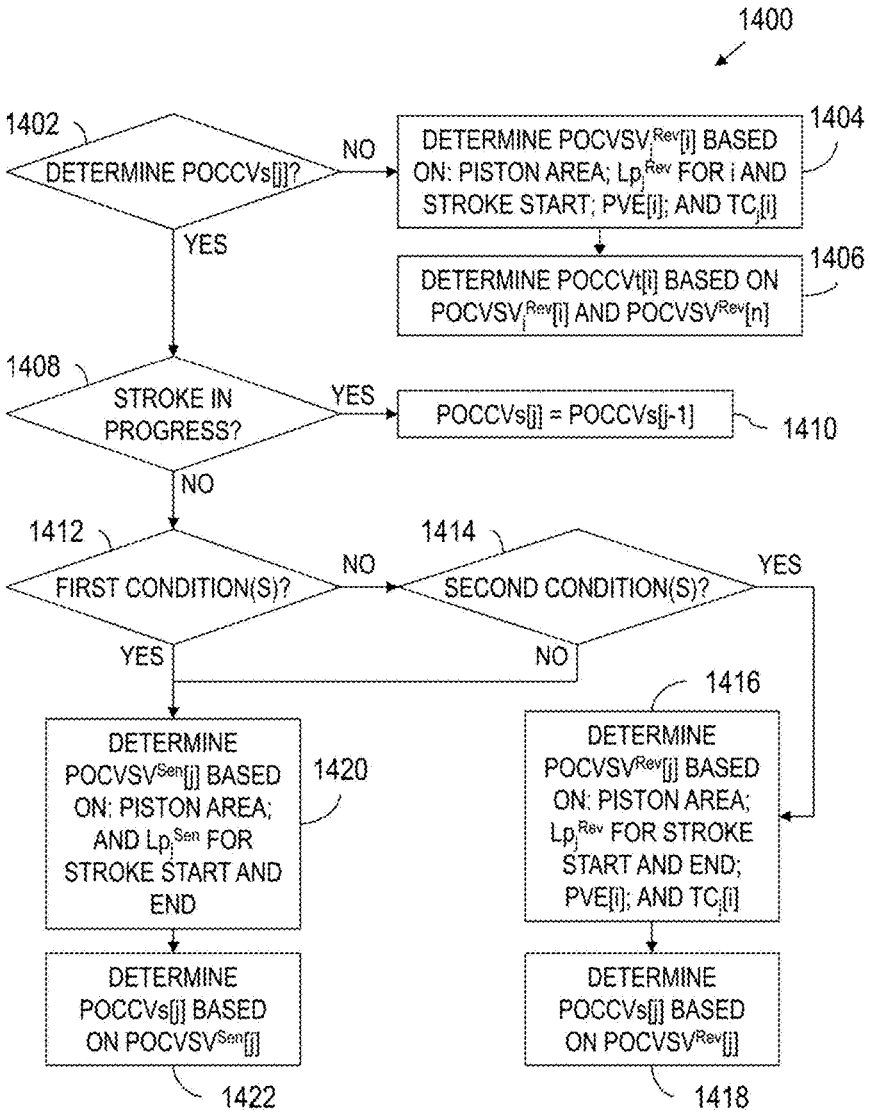
FIG. 14 is a flow-chart diagram of at least a portion of an example implementation of a method according to one or more aspects of the present disclosure.

FIG. 14 is a flow-chart diagram of at least a portion of an example implementation of a method (1400) for determining POCCV, as described above with respect to the POCCV determination (728) depicted in FIG. 7. The method (1400) determines one of POCCVs, which is a POCCV updated each stroke, or POCCVt, which is a POCCV updated each time.

The method (1400) includes determining (1402) whether to determine POCCVs[j] for each stroke j. This determination (1402) may be based on user input during initialization of the system, for example, such as the initialization (702) depicted in FIG. 7. If it is determined (1402) that POCCVs[j] is not to be determined, a corrected volume for stroke volume of stroke j based on revolutions of the motor at the current sampling time i, or $POCVSV_j^{Rev}$[i] (e.g., Pumped Out Corrected Volume for Stroke Volume), is determined (1404) utilizing Equation (13) set forth below.

$$POCVSV_j^{Rev}[i]=PistonArea*(Lp_j^{Rev}(i)-Lp_j^{Rev}(STROKE\ START))*PVE[i]*TC_j[i] \quad \text{Eq. (13)}$$

When the stroke is completed at the current data sampling time i, $POCVSV_j^{Rev}$[i] is converted into a corrected volume for stroke volume of stroke j based on revolutions of the motor, or $POCVSV^{Rev}$[j]. The corrected continuous volume updated each time $POCCV_j$[i] is then determined (1406) as the sum of $POCVSV_j^{Rev}$[i] and previous instances (of number n) of corrected volume for stroke volume of n strokes, or $POCVSV^{Rev}$[n], as set forth below in Equation (14).

$$POCCVt[i]=POCVSV_j^{Rev}[i]+\Sigma_{n=1}^{j-1}POCVSV^{Rev}[n] \quad \text{Eq. (14)}$$

If POCCVs[j] is to be determined, there is another determination (1408) as to whether the stroke is in progress. If the stroke is determined (1408) to be in progress, POCCVs[j] is set (1410) equal to the corrected continuous volume updated each stroke for the immediately preceding stroke j−1, POCCVs[j−1].

If the stroke is determined (1408) to not be in progress, there is a determination (1412) as to whether one or more predetermined first conditions exist or have occurred, and another determination (1414) as to whether one or more predetermined second conditions exist or have occurred. The predetermined first conditions include the stroke completing under normal conditions, a motor speed changing during the stroke, a motor mode changing during the stroke, and a pump type changing during the stroke. The predetermined second conditions include a stroke direction change, a pump stopping during the stroke, and a half stroke occurring.

If each of the first conditions are determined (1412) to not exist or have occurred, but at least one of the second conditions is determined (1414) to exist or have occurred, a corrected volume for stroke volume of stroke j based on the motor revolutions, or $POCVSV^{Rev}[j]$ (e.g., Pumped Out Corrected Volume for Stroke Volume), is determined (1416) utilizing Equation (15) set forth below.

$$POCVSV^{Rev}[j]=PistonArea*(Lp_j^{Rev}(STROKE\ END)-Lp_j^{Rev}(STROKE\ START))*PVE[i]*TC_j[i] \quad \text{Eq. (15)}$$

A corrected continuous volume updated each stroke POCCVs[j] is then determined (1418) utilizing Equation (16) set forth below.

$$POCCVs[j]=POCCVs[j-1]+POCVSV^{Rev}[j] \quad \text{Eq. (16)}$$

The iterative nature of the loop causes POCCVs[j] to accumulate for the strokes during an operation.

If at least one of the first conditions is determined (1412) to exist or have occurred, or if each of the first conditions is determined (1412) to not exist or have occurred and each of the second conditions is determined (1414) to not exist or have occurred, a corrected volume for stroke volume of stroke j based on the sensor, or $POCVSV^{Sen}[j]$ (e.g., Pumped Out Corrected Volume for Stroke Volume), is determined (1420) utilizing Equation (17) set forth below.

$$POCVSV^{Sen}[j]=PistonArea*(Lp_j^{Sen}(STROKE\ END)-Lp_j^{Sen}(STROKE\ START)) \quad \text{Eq. (17)}$$

A corrected continuous volume updated each stroke POCCVs[j] is then determined (1422) as the sum of the corrected volume for stroke volume $POCVSV^{Sen}$ [j] and the immediately preceding corrected continuous volume updated each stroke POCCVs[j−1], as set forth below in Equation (18).

$$POCCVs[j]=POCCVs[j-1]+POCVSV^{Sen}[j] \quad \text{Eq. (18)}$$

The iterative nature of the loop causes the corrected continuous volume updated each stroke POCCVs[j] to accumulate for the strokes during an operation.

One or more aspects of the foregoing methods and/or processes may permit a corrected flow rate of downhole fluid pumped out through a displacement unit to be determined with higher accuracy. One or more aspects of the foregoing methods and/or processes may also or instead permit a corrected continuous volume of the pumped fluid to be determined with higher accuracy.

In view of the entirety of the present disclosure, including the claims and the figures, a person having ordinary skill in the art will readily recognize that the present disclosure introduces an apparatus comprising a processing system comprising a processor and a memory including computer program code, wherein the processing system is operable to: obtain first piston position data of a piston in a displacement unit based on an output signal from a sensor associated with the displacement unit, the output signal being dependent upon a physical position of the piston in the displacement unit; obtain second piston position data of the piston in the displacement unit based on data indicative of a number of revolutions of a hydraulic motor in a hydraulic system, the hydraulic system being operable to drive the piston of the displacement unit; estimate, based on the second piston position data, an estimated flow rate of a fluid pumped by the displacement unit; generate a system correction factor based on the first piston position data and the second piston position data; and adjust the estimated flow rate based on the system correction factor.

The estimated flow rate may be estimated based on: (A) a first difference between: (1) the second piston position data corresponding to a current data sampling time; and (2) the second piston position data corresponding to a preceding data sampling time immediately preceding the current data sampling time; and (B) a second difference between the current data sampling time and the preceding data sampling time.

The processing system may be further operable to estimate an estimated volume of the fluid pumped by the displacement unit based on a difference between: the second piston position data corresponding to a current data sampling time; and the second piston position data corresponding to a beginning of a stroke of the piston. The processing system may be further operable to adjust the estimated volume based on the system correction factor.

The processing system may be further operable to: (A) when a stroke of the piston has been completed, estimate an estimated volume of the fluid pumped by the displacement unit, wherein the estimated volume may be based on: (1) when a first condition exists, a first difference between: (a) the second piston position data corresponding to an end of the stroke; and (b) the second piston position data corresponding to a beginning of the stroke; and (2) when a second condition different from the first condition exists, a second difference between: (a) the first piston position data corresponding to the end of the stroke; and (b) the first piston position data corresponding to the beginning of the stroke; and (B) when the stroke of the piston has been completed and the first condition exists, adjust the estimated volume based on the system correction factor. The first condition may include: (A) none of a first list of occurrences occurring, wherein the first list of occurrences may include: (1) the stroke completing under normal conditions; (2) a motor speed changed during the stroke; (3) a motor mode changed during the stroke; and (4) a pump type changed during the stroke; and (B) at least one of a second list of occurrences occurring, wherein the second list of occurrences may include: (1) a direction of the stroke changed; (2) a pump stopped during the stroke; and (3) a half stroke occurred. The second condition may include: at least one of the first list of occurrences occurring; or none of the first list of occurrences occurring and none of the second list of occurrences occurring.

The processing system may be further operable to generate a piston position correction factor for each data sampling time during a stroke of the piston. The piston position correction factor may be based on a first ratio of: a first difference between the first piston position data corresponding to different data sampling times during the stroke of the piston; and a second difference between the second piston position data corresponding to the different data sampling times. The processing system may be further operable to: (A) generate an instantaneous volume rate of the fluid pumped by the displacement unit for each data sampling time during the stroke, wherein the instantaneous volume rate may be based on a third difference between: (1) the second piston position data corresponding to a respective current data sampling time; and (2) the second piston position data corresponding to a preceding data sampling time immediately preceding the respective current data sampling time; (B) if the stroke has been completed: (1) estimate a first stroke volume based on a fourth difference between: (a) the first piston position data corresponding to an end of the stroke; and (b) the first piston position data corresponding to a beginning of the stroke; (2) estimate a second stroke volume based on: (a) generating, for each data sampling time during the stroke, a product of the piston position correction factor and the instantaneous volume rate for the respective data sampling time, and (b) summing the products corresponding to the data sampling times during the stroke; and (3) generate a stroke volume correction factor based on a second ratio of the first stroke volume to the second stroke volume; and (C) if the stroke has not been completed, generate the stroke volume correction factor based on a previously generated stroke volume correction factor corresponding to a previous stroke. The system correction factor may be generated based on the piston position correction factor and the stroke volume correction factor. The system correction factor may be generated dependent on half-cycling testing not occurring during a given data sampling time.

The sensor may include a giant magnetoresistance (GMR) sensor.

The first piston position data may be obtained from a look-up table stored in the memory.

The processing system may be further operable to: determine that an over-pressure relief condition occurs in the hydraulic system; and correct the number of revolutions of the hydraulic motor based on the determination that the over-pressure relief condition occurs. The processing system may be further operable to: when the over-pressure relief condition occurs, set the number of revolutions of the hydraulic motor equal to a previous number of revolutions of the hydraulic motor; and when the over-pressure relief condition does not occur, set the number of revolutions of the hydraulic motor equal to a sum of the previous number of revolutions of the hydraulic motor and a raw number of revolutions of the hydraulic motor occurring subsequent to the previous number of revolutions of the hydraulic motor.

The second piston position data may be obtained from a linear function of the number of revolutions.

The present disclosure also introduces an apparatus comprising: (A) a downhole tool comprising a flow line, a hydraulic system, a displacement unit, and a sensor, wherein: (1) the displacement unit is operable to pump a fluid through the flow line; (2) the hydraulic system comprises a hydraulic motor operable to cause a piston of the displacement unit to be driven; and (3) the sensor is associated with the displacement unit and operable to output a signal that is dependent on a physical position of the piston in the displacement unit; and (B) a processing system comprising a processor and a memory including computer program code, wherein the processing system is operable to: (1) estimate an estimated flow rate of the pumped fluid based on a first difference between first data corresponding to a current data sampling time and the first data corresponding to a previous data sampling time, wherein the first data is indicative of a position of the piston based on a number of revolutions of the hydraulic motor; and (2) correct the estimated flow rate based on a correction factor, wherein the correction factor is based on a first ratio of a second difference of second data corresponding to different, previous data sampling times and a third difference of the first data corresponding to the different, previous data sampling times, wherein the second data is indicative of a position of the piston based on the signal output from the sensor.

The sensor may include a giant magnetoresistance (GMR) sensor.

The correction factor may be further based on: (A) if a stroke of the piston is completed at the current data sampling time, a second ratio of a first stroke volume determination to a second stroke volume determination, wherein: (1) the first stroke volume determination may be based on a fourth difference between the second data corresponding to an end of the stroke and the second data corresponding to a beginning of the stroke; (2) the second stroke volume determination may be based on a summation of a plurality of products each corresponding to a respective data sampling time during the stroke; (3) each of the products may be based on the first ratio for the respective data sampling time and a volume rate for the respective data sampling time; and (4) the volume rate may be based on a fifth difference between the first data corresponding to the respective data sampling time and the first data corresponding to a previous data sampling time before the respective data sampling time; and (B) if the stroke of the piston is not completed at the current data sampling time, the second ratio corresponding to a previous stroke.

The correction factor may be further based on a half-cycling correction test not being performed at the current data sampling time.

The number of revolutions of the hydraulic motor may be corrected when an over-pressure relief condition occurs.

The processing system may be further operable to: (A) determine a stroke volume for a stroke of the piston based on a fourth difference between: (1) the first or second data corresponding to a data sampling time subsequent to a beginning of the stroke; and (2) the first or second data corresponding to the beginning of the stroke; and (B) determine a continuous volume for the stroke based on the stroke volume for the stroke. The stroke volume for the stroke may be updated at each data sampling time during the stroke, and the stroke volume for the stroke may be based on the correction factor and the fourth difference being between the first data corresponding to the current data sampling time and the first data corresponding the beginning of the stroke. The stroke volume for the stroke may be updated at a completion of the stroke and not during the stroke, wherein: when the stroke is completed under a first condition, the stroke volume for the stroke may be based on the correction factor and the fourth difference being between the first data corresponding to an end of the stroke and the first data corresponding to the beginning of the stroke; and when the stroke is completed under a second condition different from the first condition, the stroke volume for the stroke may be based on the fourth difference being between the second data corresponding to an end of the stroke and the second data corresponding to the beginning of the stroke.

The downhole tool may be operable for conveyance within a wellbore extending into a subterranean formation. The conveyance may be via wireline and/or a string of tubular members.

The present disclosure also introduces a method comprising operating a processing system comprising a processor and a memory including computer program code, wherein operating the processing system comprises: obtaining first data indicative of a position of a piston in a displacement unit for a stroke, wherein the first data is derived from an output of a sensor associated with the displacement unit, and wherein the output of the sensor is dependent on a physical position of the piston in the displacement unit; obtaining second data indicative of the position of the piston for the stroke, wherein the second data is derived from a number of revolutions of a motor in a hydraulic system operable to drive the piston in the displacement unit; estimating an estimated flow rate of a fluid pumped by the displacement unit based on a first difference between second data corresponding to a current data sampling time for the stroke and the second data corresponding to a previous data sampling time for the stroke; and correcting the estimated flow rate based on a system correction factor. The system correction factor is derived from a first ratio of: a second difference of the first data corresponding to different, previous data sampling times for the stroke; and a third difference of the second data corresponding to the different, previous data sampling times for the stroke.

The sensor may include a giant magnetoresistance (GMR) sensor.

The system correction factor may be further derived from: (A) when the stroke is completed at the current data sampling time, a second ratio of a first stroke volume determination to a second stroke volume determination, wherein: (1) the first stroke volume determination may be derived from a fourth difference between the first data corresponding to an end of the stroke and the first data corresponding to a beginning of the stroke; (2) the second stroke volume determination may be derived from a summation of a plurality of products each corresponding to a respective data sampling time during the stroke; (3) each of the products may be derived from the first ratio for the respective data sampling time and a volume rate for the respective data sampling time; and (4) the volume rate may be derived from a fifth difference between the second data corresponding to the respective data sampling time and the second data corresponding to a previous data sampling time before the respective data sampling time; and (B) when the stroke is not completed at the current data sampling time, the second ratio of a previous stroke.

The system correction factor may be further dependent upon a half-cycling correction test not being performed at the current data sampling time.

The number of revolutions of the motor may be corrected when an over-pressure relief condition occurs.

Operating the processing system may further comprise: (A) determining a stroke volume for the stroke based on a fourth difference between: (1) the first or second data corresponding to a data sampling time subsequent to a beginning of the stroke; and (2) the first or second data corresponding to the beginning of the stroke; and (B) determining a continuous volume for the stroke based on the stroke volume for the stroke. The stroke volume for the stroke may be determined at each data sampling time during the stroke, and the stroke volume may be derived from the system correction factor and the fourth difference being between: the second data corresponding to the current data sampling time; and the second data corresponding to the beginning of the stroke. The stroke volume for the stroke may be determined at a completion of the stroke and not during the stroke, wherein: (A) when the stroke is completed under a first condition, the stroke volume may be derived from the system correction factor and the fourth difference being between: (1) the second data corresponding to end of the stroke; and (2) the second data corresponding to the beginning of the stroke; and (B) when the stroke is completed under a second condition different from the first condition, the stroke volume may not be derived from the system correction factor and may be derived from the fourth difference being between: (1) the first data corresponding to an end of the stroke; and (2) the first data corresponding to the beginning of the stroke.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a processing system comprising a processor and a memory including computer program code, wherein the processing system is operable to:

obtain first piston position data of a piston in a displacement unit based on an output signal from a sensor associated with the displacement unit, the output signal being dependent upon a physical position of the piston in the displacement unit;

obtain second piston position data of the piston in the displacement unit based on data indicative of a number of revolutions of a hydraulic motor in a hydraulic system, the hydraulic system being operable to drive the piston of the displacement unit;

estimate, based on the second piston position data, an estimated flow rate of a fluid pumped by the displacement unit;

generate a system correction factor based on the first piston position data and the second piston position data; and adjust the estimated flow rate based on the system correction factor.

2. The apparatus of claim 1 wherein the estimated flow rate is estimated based on:

a first difference between:

the second piston position data corresponding to a current data sampling time; and the second piston position data corresponding to a preceding data sampling time immediately preceding the current data sampling time; and a second difference between the current data sampling time and the preceding data sampling time.

3. The apparatus of claim 1 wherein the processing system is further operable to:

estimate an estimated volume of the fluid pumped by the displacement unit based on a difference between:

the second piston position data corresponding to a current data sampling time; and the second piston position data corresponding to a beginning of a stroke of the piston; and adjust the estimated volume based on the system correction factor.

4. The apparatus of claim 1 wherein the processing system is further operable to:

when a stroke of the piston has been completed, estimate an estimated volume of the fluid pumped by the displacement unit, wherein the estimated volume is based on:

when a first condition exists, a first difference between:

the second piston position data corresponding to an end of the stroke; and the second piston position data corresponding to a beginning of the stroke; and when a second condition different from the first condition exists, a second difference between:

the first piston position data corresponding to the end of the stroke; and the first piston position data corresponding to the beginning of the stroke; and when the stroke of the piston has been completed and the first condition exists, adjust the estimated volume based on the system correction factor.

5. The apparatus of claim 4 wherein:

the first condition includes:

none of a first list of occurrences occurring, wherein the first list of occurrences includes:

the stroke completing under normal conditions;

a motor speed changed during the stroke;

a motor mode changed during the stroke; and a pump type changed during the stroke; and at least one of a second list of occurrences occurring, wherein the second list of occurrences includes:

a direction of the stroke changed;

a pump stopped during the stroke; and a half stroke occurred; and the second condition includes:

at least one of the first list of occurrences occurring; or none of the first list of occurrences occurring and none of the second list of occurrences occurring.

6. The apparatus of claim 1 wherein the processing system is further operable to generate a piston position correction factor for each data sampling time during a stroke of the piston, the piston position correction factor being based on a first ratio of:

a first difference between the first piston position data corresponding to different data sampling times during the stroke of the piston; and a second difference between the second piston position data corresponding to the different data sampling times.

7. The apparatus of claim 6 wherein the processing system is further operable to:

generate an instantaneous volume rate of the fluid pumped by the displacement unit for each data sampling time during the stroke, the instantaneous volume rate being based on a third difference between:

the second piston position data corresponding to a respective current data sampling time; and the second piston position data corresponding to a preceding data sampling time immediately preceding the respective current data sampling time;

if the stroke has been completed:

estimate a first stroke volume based on a fourth difference between:

the first piston position data corresponding to an end of the stroke; and the first piston position data corresponding to a beginning of the stroke;

estimate a second stroke volume based on:

generating, for each data sampling time during the stroke, a product of the piston position correction factor and the instantaneous volume rate for the respective data sampling time, and summing the products corresponding to the data sampling times during the stroke; and generate a stroke volume correction factor based on a second ratio of the first stroke volume to the second stroke volume; and if the stroke has not been completed, generate the stroke volume correction factor based on a previously generated stroke volume correction factor corresponding to a previous stroke.

8. The apparatus of claim 7 wherein the system correction factor is generated based on the piston position correction factor and the stroke volume correction factor.

9. The apparatus of claim 8 wherein the system correction factor is generated dependent on half-cycling testing not occurring during a given data sampling time.

10. The apparatus of claim 1 wherein the sensor includes a giant magnetoresistance (GMR) sensor.

11. The apparatus of claim 1 wherein the first piston position data is obtained from a look-up table stored in the memory.

12. The apparatus of claim 1 wherein the processing system is further operable to:

determine that an over-pressure relief condition occurs in the hydraulic system; and correct the number of revolutions of the hydraulic motor based on the determination that the over-pressure relief condition occurs.

13. The apparatus of claim 12 wherein the processing system is further operable to:

when the over-pressure relief condition occurs, set the number of revolutions of the hydraulic motor equal to a previous number of revolutions of the hydraulic motor; and when the over-pressure relief condition does not occur, set the number of revolutions of the hydraulic motor equal to a sum of the previous number of revolutions of the hydraulic motor and a raw number of revolutions of the hydraulic motor occurring subsequent to the previous number of revolutions of the hydraulic motor.

14. The apparatus of claim 1 wherein the second piston position data is obtained from a linear function of the number of revolutions.

15. An apparatus comprising:

a downhole tool comprising a flow line, a hydraulic system, a displacement unit, and a sensor, wherein:

the displacement unit is operable to pump a fluid through the flow line;

the hydraulic system comprises a hydraulic motor operable to cause a piston of the displacement unit to be driven; and the sensor is associated with the displacement unit and operable to output a signal that is dependent on a physical position of the piston in the displacement unit; and a processing system comprising a processor and a memory including computer program code, wherein the processing system is operable to:

estimate an estimated flow rate of the pumped fluid based on a first difference between first data corresponding to a current data sampling time and the first data corresponding to a previous data sampling time, wherein the first data is indicative of a position of the piston based on a number of revolutions of the hydraulic motor; and correct the estimated flow rate based on a correction factor, wherein the correction factor is based on a first ratio of a second difference of second data corresponding to different, previous data sampling times and a third difference of the first data corresponding to the different, previous data sampling times, wherein the second data is indicative of a position of the piston based on the signal output from the sensor.

16. The apparatus of claim 15 wherein the sensor includes a giant magnetoresistance (GMR) sensor.

17. The apparatus of claim 15 wherein:

the correction factor is further based on:

if a stroke of the piston is completed at the current data sampling time, a second ratio of a first stroke volume determination to a second stroke volume determination, wherein:

the first stroke volume determination is based on a fourth difference between the second data corresponding to an end of the stroke and the second data corresponding to a beginning of the stroke;

the second stroke volume determination is based on a summation of a plurality of products each corresponding to a respective data sampling time during the stroke;

each of the products is based on the first ratio for the respective data sampling time and a volume rate for the respective data sampling time; and the volume rate is based on a fifth difference between the first data corresponding to the respective data sampling time and the first data corresponding to a previous data sampling time before the respective data sampling time; and if the stroke of the piston is not completed at the current data sampling time, the second ratio corresponding to a previous stroke; and the processing system is further operable to:

determine a stroke volume for a stroke of the piston based on a fourth difference between:

the first or second data corresponding to a data sampling time subsequent to a beginning of the stroke; and the first or second data corresponding to the beginning of the stroke; and determine a continuous volume for the stroke based on the stroke volume for the stroke.

18. A method comprising:

operating a processing system comprising a processor and a memory including computer program code, wherein operating the processing system comprises:

obtaining first data indicative of a position of a piston in a displacement unit for a stroke, wherein the first data is derived from an output of a sensor associated with the displacement unit, and wherein the output of the sensor is dependent on a physical position of the piston in the displacement unit;

obtaining second data indicative of the position of the piston for the stroke, wherein the second data is derived from a number of revolutions of a motor in a hydraulic system operable to drive the piston in the displacement unit;

estimating an estimated flow rate of a fluid pumped by the displacement unit based on a first difference between second data corresponding to a current data sampling time for the stroke and the second data corresponding to a previous data sampling time for the stroke; and correcting the estimated flow rate based on a system correction factor, wherein the system correction factor is derived from a first ratio of:

a second difference of the first data corresponding to different, previous data sampling times for the stroke; and a third difference of the second data corresponding to the different, previous data sampling times for the stroke.

19. The method of claim 18 wherein the system correction factor is further derived from:

when the stroke is completed at the current data sampling time, a second ratio of a first stroke volume determination to a second stroke volume determination, wherein:

the first stroke volume determination is derived from a fourth difference between the first data corresponding to an end of the stroke and the first data corresponding to a beginning of the stroke;

the second stroke volume determination is derived from a summation of a plurality of products each corresponding to a respective data sampling time during the stroke;

each of the products is derived from the first ratio for the respective data sampling time and a volume rate for the respective data sampling time; and the volume rate is derived from a fifth difference between the second data corresponding to the respective data sampling time and the second data corresponding to a previous data sampling time before the respective data sampling time; and when the stroke is not completed at the current data sampling time, the second ratio of a previous stroke.

20. The method of claim 18 wherein operating the processing system further comprises:

determining a stroke volume for the stroke based on a fourth difference between:

the first or second data corresponding to a data sampling time subsequent to a beginning of the stroke; and the first or second data corresponding to the beginning of the stroke; and determining a continuous volume for the stroke based on the stroke volume for the stroke.

* * * * *